US009611525B2

(12) United States Patent
Hiraide et al.

(10) Patent No.: US 9,611,525 B2
(45) Date of Patent: Apr. 4, 2017

(54) FERRITIC STAINLESS STEEL FOR BIOFUEL SUPPLY SYSTEM PART, BIOFUEL SUPPLY SYSTEM PART, FERRITIC STAINLESS STEEL FOR EXHAUST HEAT RECOVERY UNIT, AND EXHAUST HEAT RECOVERY UNIT

(75) Inventors: Nobuhiko Hiraide, Shunan (JP); Fumio Fudanoki, Nagoya (JP); Shunji Sakamoto, Kitakyushu (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 617 days.

(21) Appl. No.: 14/007,807

(22) PCT Filed: Mar. 28, 2012

(86) PCT No.: PCT/JP2012/058092

§ 371 (c)(1),
(2), (4) Date: Sep. 26, 2013

(87) PCT Pub. No.: WO2012/133506

PCT Pub. Date: Oct. 4, 2012

(65) Prior Publication Data

US 2014/0069619 A1 Mar. 13, 2014

(30) Foreign Application Priority Data

| | | |
|---|---|---|
| Mar. 29, 2011 | (JP) | 2011-071372 |
| Mar. 29, 2011 | (JP) | 2011-071812 |
| Mar. 14, 2012 | (JP) | 2012-057362 |
| Mar. 14, 2012 | (JP) | 2012-057363 |

(51) Int. Cl.

| | |
|---|---|
| ***C22C 38/54*** | (2006.01) |
| ***F28F 19/02*** | (2006.01) |
| ***C22C 38/48*** | (2006.01) |
| ***C22C 38/42*** | (2006.01) |
| ***C22C 38/32*** | (2006.01) |
| ***C22C 38/30*** | (2006.01) |
| ***C22C 38/28*** | (2006.01) |
| ***C22C 38/26*** | (2006.01) |
| ***C22C 38/24*** | (2006.01) |
| ***C22C 38/22*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***F28F 21/08*** | (2006.01) |
| ***F28D 21/00*** | (2006.01) |
| ***F02M 37/00*** | (2006.01) |

(52) U.S. Cl.

CPC ..... *C22C 38/54* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/42* (2013.01); *C22C 38/48* (2013.01); *F28D 21/0003* (2013.01); *F28F 19/02* (2013.01); *F28F 21/083* (2013.01); *C21D 2211/005* (2013.01); *F02M 37/0011* (2013.01)

(58) Field of Classification Search

CPC ... C22C 38/001; C22C 38/002; C22C 38/004; C22C 38/005; C22C 38/008; C22C 38/02; C22C 38/04; C22C 38/06; C22C 38/22; C22C 38/24; C22C 38/26; C22C 38/28; C22C 38/30; C22C 38/32; C22C 38/42; C22C 38/48; C22C 38/54; F02M 37/0011; F28D 21/0003; F28F 19/02; F28F 21/083; C21D 2211/005

See application file for complete search history.

(56) References Cited

U.S. PATENT DOCUMENTS

2010/0272594 A1* 10/2010 Hiraide ..... C22C 38/02 420/41

FOREIGN PATENT DOCUMENTS

| | | |
|---|---|---|
| CN | 101578385 A | 11/2009 |
| EP | 2224030 | 9/2010 |
| JP | 60-230962 | 11/1985 |
| JP | 07-180001 | 7/1995 |
| JP | 08-109443 | 4/1996 |
| JP | 2001-355048 | 12/2001 |

(Continued)

OTHER PUBLICATIONS

Muto et al., English machine translation of JP 08-109443, Apr. 1996, p. 1-16.*

Office Action dated Feb. 6, 2015 issued in corresponding KR Application No. 10-2013-7024892. [Translation included].

Office Action dated Oct. 29, 2014 issued in corresponding Chinese Application No. 201280015457.9 [with English Translation].

(Continued)

*Primary Examiner* — Roy King

*Assistant Examiner* — Caitlin Kiechle

(74) *Attorney, Agent, or Firm* — Birch, Stewart, Kolasch & Birch, LLP

(57) ABSTRACT

An aspect of a ferritic stainless steel contains, by mass %: C: 0.03% or less; N: 0.03% or less; Si: more than 0.1% to 1% or less; Mn: 0.02% to 1.2%; Cr: 15% to 23%; Al: 0.002% to 0.5%; and either one or both of Nb and Ti, with the remainder being Fe and unavoidable impurities, wherein Expression (1) and Expression (2) illustrated below are satisfied, an oxide film is formed on a surface thereof, and the oxide film contains Cr, Si, Nb, Ti and Al in a total cationic fraction of 30% or more, $$8(C+N)+0.03 \leq Nb+Ti \leq 0.6 \quad (1)$$

$$Si+Cr+Al+\{Nb+Ti-8(C+N)\} \geq 15.5 \quad (2).$$

8 Claims, No Drawings

(56) References Cited

FOREIGN PATENT DOCUMENTS

| | | | |
|---|---|---|---|
| JP | 2002-285300 | | 10/2002 |
| JP | 2002-363712 | | 12/2002 |
| JP | 2003-277992 | | 10/2003 |
| JP | 2005-200746 | | 7/2005 |
| JP | 2006-134662 | | 5/2006 |
| JP | 2007-092163 | | 4/2007 |
| JP | 2008-001945 | | 1/2008 |
| JP | 2008-038183 | | 2/2008 |
| JP | 2008-190003 | | 8/2008 |
| JP | 2008-285731 | | 11/2008 |
| JP | 2009-007663 | | 1/2009 |
| JP | 2009-097079 | | 5/2009 |
| JP | 2009-174046 | | 8/2009 |
| JP | 2009-215633 | | 9/2009 |
| JP | 2009-228036 | | 10/2009 |
| JP | 2010-024527 | | 2/2010 |
| JP | 2010-121208 | | 6/2010 |
| JP | 2010-202973 | | 9/2010 |
| JP | 2011-157616 | A | 8/2011 |
| KR | 10-2010-0087236 | | 8/2010 |
| WO | WO 2011/114964 | A1 | 9/2011 |

OTHER PUBLICATIONS

International Search Report dated Jul. 10, 2012 issued in corresponding PCT Application No. PCT/JP2012/058092 [With English Translation].

Office Action dated Jun. 30, 2015 issued in corresponding JP Application No. 2012-057362. [Partial Translation included].

Journal of the JWS vol. 61 (1992) No. 4, pp. 67 to 74. [Partial Translation included].

"Atmosphere Brazing Fact," Welding Technology, Apr. 2001, pp. 93-99.

Notice of Reason for Cancellation (Counterpart Application) JP2012-057362, dated Sep. 29, 2016.

Opposition (Counterpart Application) JP2012-057362, dated Aug. 24, 2016.

Partial Chinese Office Action, CN 201510761562.2, Oct. 9, 2016 (7 pages).

Handbook of Stainless Steel, Stainless Steel Association, Third Edition, first printing on Jan. 24, 1995 with partial translation.

Written Argument issued in counterpart application JP 2012-057362 (Appeal 2016-700704) on Nov. 28, 2016.

Opposition Decision mailed Jan. 11, 2017 for counterpart Japanese Patent Application No. 2012-057362 (with English Translation).

* cited by examiner

FERRITIC STAINLESS STEEL FOR BIOFUEL SUPPLY SYSTEM PART, BIOFUEL SUPPLY SYSTEM PART, FERRITIC STAINLESS STEEL FOR EXHAUST HEAT RECOVERY UNIT, AND EXHAUST HEAT RECOVERY UNIT

TECHNICAL FIELD

The present invention relates to a ferritic stainless steel suitable for an automotive fuel supply system part which supplies biofuels such as bioethanol or biodiesel, and a biofuel supply system part. In particular, the present invention relates to a ferritic stainless steel suitable for a biofuel supply system part such as a fuel injection system part which is in the proximity of an engine and thus, is prone to become hot.

In addition, the present invention relates to a ferritic stainless steel for an automotive exhaust heat recovery unit, and an exhaust heat recovery unit. In particular, the present invention relates to a ferritic stainless steel suitable for an exhaust heat recovery unit where a heat exchange section is fabricated by brazing.

This application is a national stage application of International Application No. PCT/JP2012/058092, filed Mar. 28, 2012, which claims priority on Japanese Patent Application No. 2011-071372 filed on Mar. 29, 2011, Japanese Patent Application No. 2011-071812 filed on Mar. 29, 2011, Japanese Patent Application No. 2012-057362 filed on Mar. 14, 2012, and Japanese Patent Application No. 2012-057363 filed on Mar. 14, 2012, the contents of which are incorporated herein by reference.

BACKGROUND ART

In recent years, as the awareness on environmental issues has grown in the automotive field, exhaust emission regulations have become more stringent and countermeasures have been underway to suppress carbon dioxide gas emission.

For example, in addition to the countermeasures such as weight reduction or the installation of exhaust gas treatment devices such as an Exhaust Gas Recirculation (EGR), a Diesel Particulate Filter (DPF), a urea Selective Catalytic Reduction (SCR) system or the like, countermeasures such as the use of fuels, for example, bioethanol, biodiesel fuel or the like have been in practice.

Bioethanol is an ethanol produced from biomass, and is mixed with gasoline to be used as a fuel for a gasoline engine. Biodiesel fuel is a fuel obtained by mixing fatty acid methyl ester with a diesel fuel and used as a fuel for a diesel engine. Herein, ethanol is produced from raw materials such as corn or sugar cane. Fatty acid methyl ester is produced by esterifying raw materials such as plant oils or waste oils, and examples of the plant oils include rapeseed oil, soybean oil, coconut oil and the like.

Biofuels such as bioethanol or biodiesel fuel have a high corrosiveness to metal materials compared to typical fuels. When a biofuel is used, the effects of the biofuel are examined in advance on the in-use performance of various members which configure fuel system parts. The needs for materials with a higher reliability have been requested from manufacturers who commit themselves to ensure an ultra-long use-life of parts, and stainless steel is one of the candidate materials.

The following technologies are known as the related arts where stainless steel is used for a fuel tank or a fuel supply tube among fuel system parts.

Patent Document 1 discloses a ferritic stainless steel sheet which contains, by mass %, C, 0.015% or less, Si: 0.5% or less, Cr: 11.0% to 25.0%, N, 0.020% or less, Ti: 0.05% to 0.50%, Nb: 0.10% to 0.50% and B: 0.0100% or less, and, as necessary, further contains, by mass %, one or more elements selected from among Mo: 3.0% or less, Ni: 2.0% or less, Cu: 2.0% or less and Al: 4.0% or less. The total elongation of the steel sheet is in a range of 30% or more, and the Lankford value thereof is in a range of 1.3 or more.

Patent Document 2 discloses a ferritic stainless steel sheet which contains, by mass %, C, 0.01% or less, Si: 1.0% or less, Mn: 1.5% or less, P: 0.06% or less, S: 0.03% or less, Cr: 11% to 23%, Ni: 2.0% or less, Mo: 0.5% to 3.0%, Al: 1.0% or less and N, 0.04% or less, and satisfies a relational expression of $Cr+3.3Mo \geq 18$. The steel sheet further contains either one or both of 0.8% or less of Nb and 1.0% or less of Ti and satisfies a relational expression of $18 \leq Nb/(C+N)+2Ti/(C+N) \leq 60$. The grain size number of the ferrite crystal grains of the steel sheet is in a range of 6.0 or more, and an average r-value is in a range of 2.0 or more.

Patent Document 3 discloses a ferritic stainless steel sheet which contains, by mass %, C, 0.01% or less, Si: 1.0% or less, Mn: 1.5% or less, P: 0.06% or less, S: 0.03% or less, Al: 1.0% or less, Cr: 11% to 20%, Ni: 2.0% or less, Mo: 0.5% to 3.0%, V: 0.02% to 1.0% and N: 0.04% or less, and contains, by mass %, either one or both of 0.01% to 0.8% of Nb and 0.01% to 1.0% of Ti. When the steel sheet is subjected to a uniaxial tension and deformed by 25%, the height of an undulation generated on the surface is in a range of 50 μm or less.

However, the technologies in Patent Documents 1 to 3 deal with corrosion resistance against typical gasoline. As described below, since corrosiveness of biofuels was greatly different from corrosiveness of gasoline, the technologies were not sufficient enough to deal with corrosion resistance against the biofuels.

In addition, in the related art, it is hard to say that corrosiveness of biofuels to stainless steel are necessarily made clear in detail, and that corrosion resistance of various stainless steels against biofuels is necessarily made clear.

In addition to the above-described countermeasures on fuel as countermeasures for environmental issues in the automotive field, a countermeasure is launched to improve fuel economy by mounting a heat exchanger recovering exhaust heat, a so-called exhaust heat recovery unit on hybrid vehicles. The exhaust heat recovery unit is a system where exhaust gas heats engine coolant and the heated engine coolant is used for a heater or the warm-up of an engine, and is also called as an exhaust heat recirculation system. Accordingly, the exhaust heat recovery unit shortens a time from cold start to engine stop in hybrid vehicles, and contributes to improvement in fuel economy particularly in the winter season.

A heat exchange section of an exhaust heat recovery unit is required to have a good thermal conductivity to obtain a good thermal efficiency. In addition, since a heat exchange section is in contact with exhaust gas, the heat exchange section is required to have excellent corrosion resistance against condensate water in exhaust gas. On the other hand, the exterior of the exhaust heat recovery unit is also required to have excellent corrosion resistance against salt damage. Such a corrosion resistance is required even for members in the downstream of an exhaust system where a muffler is a main body. However, since there is a concern that the corrosion in the exhaust heat recovery unit results in a serious accident such as the leakage of coolant, the exhaust heat recovery unit is required to have greater safety and better corrosion resistance.

In the related art, ferritic stainless steels such as SUS430LX, SUS436JIL and SUS436L containing 17% or more of Cr are used for portions where corrosion resistance is particularly required among members in the downstream of an exhaust system where a muffler is a main body. The material of an exhaust heat recovery unit is required to have corrosion resistance equal to or higher than corrosion resistance of these stainless steels.

In addition, since the structure of a heat exchange section is complicated, the heat exchange section is fabricated not only by welding but also by brazing. The material of a heat exchange section fabricated by brazing is required to have good brazeability. Furthermore, since an exhaust heat recovery unit is installed in the downstream of an underfloor catalytic converter in many cases, the temperature of exhaust gas becomes high at the inlet of the exhaust heat recovery unit. In addition, exhaust gas is forcibly cooled by heat exchange. Therefore, the exhaust heat recovery unit is required to have good thermal fatigue characteristics.

Patent Document 4 discloses an automotive exhaust heat recovery device made of a ferritic stainless steel. The ferritic stainless steel contains C, 0.020% or less, Si: 0.05% to 0.70%, Mn: 0.05% to 0.70%, P: 0.045% or less, S: 0.005% or less, Ni: 0.70% or less, Cr: 18.00% to 25.50%, Cu: 0.70% or less, Mo: 2/(Cr-17.00) % to 2.50% and N: 0.020% or less. The ferritic stainless steel further contains either one or both of 0.50% or less of Ti and 0.50% or less of Nb and satisfies a relational expression of $(Ti+Nb) \geq (7 \times (C+N)+0.05)$, and the remainder thereof is Fe and unavoidable impurities. In the ferritic stainless steel according to Patent Document 4, Mo is added together with 18% or more of Cr; and thereby, corrosion resistance against condensate water in exhaust gas is ensured.

Patent Document 5 discloses a ferritic stainless steel sheet which contains C, 0.05% or less, Si: 0.02% to 1.0%, Mn: 0.5% or less, P: 0.04% or less, S: 0.02% or less, Al: 0.1% or less, Cr: 20% to 25%, Cu: 0.3% to 1.0%, Ni: 0.1% to 3.0%, Nb: 0.2% to 0.6% and N: 0.05% or less, and has excellent crevice corrosion resistance. The steel sheet includes Nb carbonitrides having sizes of 5 μm or smaller, and the surface roughness Ra of the steel sheet is in a range of 0.4 μm or smaller. In the ferritic stainless steel sheet according to Patent Document 5, both of Ni and Cu are added together with 20% or more of Cr; and thereby, crevice corrosion resistance is ensured.

Patent Document 6 discloses an automotive exhaust gas passage member made of a ferritic stainless steel. The ferritic stainless steel contains C, 0.015% or less, Si: 2.0% or less, Mn: 1.0% or less, P: 0.045% or less, S: 0.010% or less, Cr: 16% to 25%, Nb: 0.05% to 0.2%, Ti: 0.05% to 0.5%, N, 0.025% or less and Al: 0.02% to 1.0%. The steel further contains either one or both of 0.1% to 2.0% of Ni and 0.1% to 1.0% of Cu at a total content (Ni+Cu) of 0.6% or more. In the ferritic stainless steel sheet according to Patent Document 6, Ni and Cu are added at a total content of 0.6% or more; and thereby, good corrosion resistance is achieved at a low cost without the use of expensive Mo.

Patent Document 7 discloses a stainless steel for a heat pipe of a high-temperature exhaust heat recovery device which contains Cr: 16% to 30%, Ni: 7% to 20%, C, 0.08% or less, N, 0.15% or less, Mn: 0.1% to 3%, S: 0.008% or less and Si: 0.1% to 5%, and satisfies $Cr+1.5Si \geq 1$ and $0.009Ni+0.014Mo+0.005Cu-(0.085Si+0.008Cr+0.003Mn) \leq -0.25$. A technology according to Patent Document 7 relates to not a heat exchanger where heat is exchanged between exhaust heat and coolant, but an exhaust heat recovery unit using a heat transmission device which is called as a heat pipe. Patent Document 7 discloses an austenitic stainless steel suitable for the heat pipe.

An exhaust heat recovery unit is required to have corrosion resistance equal to or higher than corrosion resistance of a ferritic stainless steel containing 17% or more of Cr. However, in a ferritic stainless steel containing 17% or more of Cr in the related art, corrosion resistance after brazing was not considered. For this reason, when the existing ferritic stainless steel was used for an exhaust heat recovery unit, corrosion resistance after brazing could not be sufficiently ensured due to a change in the metallographic texture of a brazed portion or the progress of oxidation of the steel surface.

PRIOR ART DOCUMENT

Patent Document

Patent Document 1: Japanese Unexamined Patent Application, First Publication No. 2003-277992

Patent Document 2: Japanese Unexamined Patent Application, First Publication No. 2002-285300

Patent Document 3: Japanese Unexamined Patent Application, First Publication No. 2002-363712

Patent Document 4: Japanese Unexamined Patent Application, First Publication No. 2009-228036

Patent Document 5: Japanese Unexamined Patent Application, First Publication No. 2009-7663

Patent Document 6: Japanese Unexamined Patent Application, First Publication No. 2007-92163

Patent Document 7: Japanese Unexamined Patent Application, First Publication No. 2010-24527

DISCLOSURE OF THE INVENTION

Problems to be Solved by the Invention

The present invention is proposed in light of the problems in the related art, and in particular, an object of the present invention is to provide a ferritic stainless steel for a biofuel supply system part which has corrosion resistance against biofuels.

In addition, in particular, another object of the present invention is to provide a ferritic stainless steel sheet for an exhaust heat recovery unit which can be suitably used for a heat exchange section fabricated by brazing and which has excellent corrosion resistance against condensate water in exhaust gas.

Means for Solving the Problems

The following is a summary of a first aspect of the present invention to solve the problems.

[1] A ferritic stainless steel for a biofuel supply system part contains, by mass %: CL 0.03% or less; N: 0.03% or less; Si: more than 0.1% to 1% or less; Mn: 0.02% to 1.2%; Cr: 15% to 23%; Al: 0.002% to 0.5%; and either one or both of Nb and Ti, with the remainder being Fe and unavoidable impurities, wherein Expression (1) and Expression (2) illustrated below are satisfied, an oxide film is formed on a surface thereof, and the oxide film contains Cr, Si, Nb, Ti and Al in a total cationic fraction of 30% or more.

$$8(C+N)+0.03 \leq Nb+Ti \leq 0.6 \quad (1)$$

$$Si+Cr+Al+\{Nb+Ti-8(C+N)\} \geq 15.5 \quad (2)$$

Each element symbol represents the content (mass %) of the element in Expression (1) and Expression (2).

[2] The ferritic stainless steel for a biofuel supply system part according to the above-described [1] further contains, by mass %, one or more elements selected from a group consisting of Ni: 2% or less, Cu: 1.5% or less, Mo: 3% or less, and Sn: 0.5% or less.

[3] The ferritic stainless steel for a biofuel supply system part according to the above-described [1] or [2] further contains, by mass %, one or more elements selected from a group consisting of V: 1% or less, W: 1% or less, B: 0.005% or less, Zr: 0.5% or less, Co: 0.2% or less, Mg: 0.002% or less, Ca: 0.002% or less and REM: 0.01% or less.

[4] A biofuel supply system part is made of the ferritic stainless steel for a biofuel supply system part according to any one of the above-described [1] to [3].

The following is a summary of a second aspect of the present invention to solve the problems.

[5] A ferritic stainless steel for an exhaust heat recovery unit contains, by mass %: C: 0.03% or less; N: 0.05% or less; Si: more than 0.1% to 1% or less; Mn: 0.02% to 1.2%; Cr: 17% to 23%; Al: 0.002% to 0.5%; either one or both of Nb and Ti; and two or three elements selected from a group consisting of Ni: 0.25% to 1.5%, Cu: 0.25% to 1% and Mo: 0.5% to 2%, with the remainder being Fe and unavoidable impurities, wherein Expression (3) and Expression (4) illustrated below are satisfied, an oxide film is formed on a surface thereof, and the oxide film contains Cr, Si, Nb, Ti and Al in a total cationic fraction of 40% or more.

$$8(C+N)+0.03 \leq Nb+Ti \leq 0.6 \quad (3)$$

$$Si+Cr+Al+\{Nb+Ti-8(C+N)\} \geq 17.5 \quad (4)$$

Each element symbol represents the content (mass %) of the element in Expression (3) and Expression (4). In addition, the value of Nb+Ti−8(C+N) is equal to or greater than 0 in Expression (4).

[6] A ferritic stainless steel for an exhaust heat recovery unit contains, by mass %: C: 0.03% or less; N: 0.05% or less; Si: more than 0.1% to 1% or less; Mn: 0.02% to 1.2%; Cr: 17% to 23%; Al: 0.002% to 0.5%; either one or both of Nb and Ti; and two or three elements selected from a group consisting of Ni: 0.25% to 1.5%, Cu: 0.25% to 1% and Mo: 0.5% to 2%, with the remainder being Fe and unavoidable impurities, wherein Expression (3) and Expression (4) illustrated below are satisfied, an oxide film is formed on a surface thereof by heat treatment in a vacuum atmosphere containing $N_2$ with a vacuum of $10^{-2}$ torr to 1 torr or in an $H_2$ atmosphere containing $N_2$, and the oxide film contains Cr, Si, Nb, Ti and Al in a total cationic fraction of 40% or more.

$$8(C+N)+0.03 \leq Nb+Ti \leq 0.6 \quad (3)$$

$$Si+Cr+Al+\{Nb+Ti-8(C+N)\} \geq 17.5 \quad (4)$$

Each element symbol represents the content (mass %) of the element in Expression (3) and Expression (4). In addition, the value of Nb+Ti−8(C+N) is equal to or greater than 0 in Expression (4).

[7] The ferritic stainless steel for an exhaust heat recovery unit according to the above-described [5] or [6] further contains, by mass %, one or more elements selected from a group consisting of V: 0.5% or less, W: 1% or less, B: 0.005% or less, Zr: 0.5% or less, Sn: 0.5% or less, Co: 0.2% or less, Mg: 0.002% or less, Ca: 0.002% or less and REM: 0.01% or less.

[8] An exhaust heat recovery unit includes a heat exchange section of which members are fabricated by brazing. The heat exchange section is made of a ferritic stainless steel. The ferritic stainless steel contains, by mass %: C: 0.03% or less; N, 0.05% or less; Si: more than 0.1% to 1% or less; Mn: 0.02% to 1.2%; Cr: 17% to 23%; Al: 0.002% to 0.5%; either one or both of Nb and Ti; and two or three elements selected from a group consisting of Ni: 0.25% to 1.5%, Cu: 0.25% to 1% and Mo: 0.5% to 2%, with the remainder being Fe and unavoidable impurities, wherein Expression (3) and Expression (4) illustrated below are satisfied, an oxide film is formed on a surface thereof, and the oxide film contains Cr, Si, Nb, Ti and Al in a total cationic fraction of 40% or more.

$$8(C+N)+0.03 \leq Nb+Ti \leq 0.6 \quad (3)$$

$$Si+Cr+Al+\{Nb+Ti-8(C+N)\} \geq 17.5 \quad (4)$$

Each element symbol represents the content (mass %) of the element in Expression (3) and Expression (4). In addition, the value of Nb+Ti−8(C+N) is equal to or greater than 0 in Expression (4).

[9] The exhaust heat recovery unit according to the above-described [8] is made of the ferritic stainless steel which further contains one or more elements selected from a group consisting of, by mass %, V: 0.5% or less, W: 1% or less, B: 0.005% or less, Zr: 0.5% or less, Sn: 0.5% or less, Co: 0.2% or less, Mg: 0.002% or less, Ca: 0.002% or less and REM: 0.01% or less.

Effects of the Invention

The first aspect of the present invention can provide a ferritic stainless steel which has excellent corrosion resistance against biofuels. The ferritic stainless steel can be suitably used for a biofuel supply system part. In particular, the ferritic stainless steel is suitable for a biofuel supply system part such as a fuel injection system part which is in the proximity of an engine and thus, is prone to become hot.

The second aspect of the present invention can provide a ferritic stainless steel for an exhaust heat recovery unit which has corrosion resistance against condensate water in exhaust gas after brazing. The ferritic stainless steel can be suitably used for a member of an exhaust heat recovery unit. In particular, the ferritic stainless steel can be suitably used for a heat exchange section fabricated by brazing.

BEST MODE FOR CARRYING OUT THE INVENTION

Hereinafter, embodiments of the present invention will be described in detail.

First Embodiment

The inventors collected fuels such as E10, E22 and E100 containing bioethanol and generally used in North America, and biodiesel fuels such as rapeseed methylester (RME) generally used in Europe. E10 and E22 are fuels obtained by mixing bioethanol with gasoline at the bioethanol contents of 10% and 22%, respectively, and the bioethanol content of E100 is 100%. RME is a fuel produced by methyl-esterifying rapeseed oil. Oxidation degradation behavior of these fuels and corrosiveness thereof to stainless steels were investigated and analyzed in detail in comparison to typical gasoline.

First, the oxidation stabilities of E10, E22, E100 and RME were evaluated according to a JIS K2287 used as a method of evaluating the oxidation stability of gasoline, and were compared to the oxidation stability of gasoline. Each fuel was enclosed in an autoclave, 7 atm of oxygen was introduced thereinto, and the temperature thereof was raised to 100° C. and retained at 100° C. In this state, a pressure change was measured to evaluate a behavior of pressure decay caused by the use of oxygen for the oxidation of fuel.

As a result, the following points were made clear. (1) E10 and E100 were less prone to degradation by oxidation than gasoline. (2) E22 and RME were more prone to degradation by oxidation than gasoline, and the degree of oxidation degradation of RME was the largest.

When fuel is oxidized, fatty acids such as formic acid, acetic acid and propionic acid are produced. First, in order to know corrosiveness of fatty acids, cold rolled stainless steel sheets were immersed in oxidized RME and gasoline to check for the presence of corrosion. As a result, corrosion was not found in any case.

This is because fatty acids, which are oxidation products, are present as a dimer in a medium of fuel. Fatty acids need to be dissociated to release hydrogen ions in order for the fatty acids to exhibit corrosiveness; and therefore, the presence of water was considered to be essential. In actual environment, since moisture in the air is condensed to become water, it is very important to take the coexistence of aqueous phase into consideration.

Water (10 vol %) was added to oxidized RME and gasoline, respectively and cold rolled stainless steel sheets were immersed therein. As a result, corrosion was produced in any of RME and gasoline.

It was confirmed from this result that the coexistence of water was essential to the exhibition of corrosiveness of degraded fuel by oxidation, and corrosiveness was revealed only after fatty acids in the fuel were distributed to aqueous phase. Since corrosive materials in the aqueous phase are hydrogen ions, corrosiveness is represented by the concentration of the hydrogen ions. The concentration of hydrogen ions in water mainly depends on the types and the concentration of fatty acids in oxidized fuel and a behavior of fatty acids being distributed between fuel and aqueous phase. A behavior of fatty acids being distributed is affected by temperature among these, and the higher the temperature is, the easier the fatty acids are distributed from fuel to aqueous phase.

In addition, pH of aqueous phase is 2.1 in RME, pH of aqueous phase is 3.0 in gasoline, and the difference between the two pH values is 0.9. When the difference is converted into the concentration of fatty acids, the converted value corresponds to approximately 100 times a difference in the concentration of the fatty acids. In the related art, a corrosion test using oxidation-degraded gasoline is performed at the combined concentration of formic acid and acetic acid in water in the range of 100 ppm to 1,000 ppm. For this reason, in a corrosion test using biofuel such as RME, it was found that the combined concentration of formic acid and acetic acid was required to be increased to 1% to 10% which corresponded to approximately 100 times the combined concentration in the case of gasoline.

In addition, the temperatures of fuel injection system parts and the like in the proximity of an engine are increased to a range of 90° C. to 100° C., fatty acids become easily distributed from fuel to aqueous phase along with the temperature increase, and thus corrosion environment becomes severe. The corrosion environment is severe compared to a corrosion test at a temperature of 40° C. to 50° C. using oxidation-degraded gasoline.

Furthermore, bioethanol in fuel moves to aqueous phase to enlarge the portion of aqueous phase and, in particular, becomes a factor which inhibits stainless steel from maintaining a passivation (passive state).

As such, since corrosiveness of biofuels are severe compared to typical gasoline, materials used for biofuel supply system parts are required to have better corrosion resistance.

Accordingly, the inventors intensively examined corrosion resistance in a high-temperature acidic fatty acid environment. As a result, the following points were found. (1) It is the most important that a stable oxide film is formed on the surface of stainless steel; and thereby, the passivation thereof is maintained and occurrence of corrosion is suppressed. (2) In the case where an oxide film is formed on the surface of stainless steel and the oxide film contains Cr, Si, Nb, Ti and Al in a total cationic fraction ({(Cr+Si+Nb+Ti+Al)/(the total content of cations)}×100) of 30% or more, excellent corrosion resistance is exerted in high-temperature acidic fatty acid environment.

First, the chemical composition of steel material is required to satisfy Expression (2) illustrated below to form such an oxide film.

$$Si+Cr+Al+\{Nb+Ti-8(C+N)\}\geq 15.5 \quad (2)$$

Each element symbol represents the content (mass %) of the element in Expression (2).

The entireties of Nb and/or Ti included in stainless steel are not present in a solid solution state, and portions thereof are present in a state where the portions are fixed to C and N. Among Nb and/or Ti included in stainless steel, Nb and/or Ti, which are not fixed to C and N and are in a solid solution state, are concentrated in a passive film (oxide film) by heat treatment. Nb and Ti contribute to the prevention of corrosion in an oxide film formed by heat treatment. Among Nb and/or Ti included in stainless steel, the content of Nb and/or Ti, which are fixed to C and N and do not turn into a solid solution state, is considered to be approximately 8 times the total content (C+N) of C and N, when considering ratios of an atomic mass of Nb of 93, an atomic mass of C of 12 and an atomic mass of N of 14. Therefore, it is necessary to set the total content of Si, Cr, Al and {Nb+Ti−8(C+N)} included in stainless steel to be in a range of 15.5% or more so as to form the oxide film that suppresses occurrence of corrosion. The total content is more preferably in a range of 17.5% or more.

Furthermore, an oxide film having the above-described composition is formed by adjusting process conditions such as heat treatment and pickling.

A heat treatment performed when members are brazed to become a part, is cited as a heat treatment which forms an oxide film with the above-described cationic fraction on the surface of steel material with the above-described chemical composition. For example, among fuel injection system parts such as a delivery tube or a common rail, there are some parts which are manufactured by the brazing of members. A condition where members are retained in a vacuum atmosphere containing $N_2$ with a vacuum of $10^{-2}$ torr to 1 torr (atmosphere with reduced pressure) or in an $H_2$ atmosphere containing $N_2$ for 0.5 minutes to 30 minutes at a temperature of 800° C. to 1,200° C., is cited as a condition of heat treatment performed when such a part is manufactured by brazing. An oxide film with a desired composition can be suitably formed under this condition. Herein, the total cationic fraction of Cr, Si, Nb, Ti and Al in a formed oxide film does not reach the desired cationic fraction only by heat treatment in a vacuum of $10^{-2}$ torr or less. For example, an atmosphere is vacuumed to $10^{-2}$ torr or less and then $N_2$ is introduced thereinto to set a pressure to be in a range of $10^{-2}$ torr to 1 torr. An oxide film with a desired composition can be obtained by heat treatment in such an atmosphere. On the other hand, $N_2$ may be introduced into an $H_2$ atmosphere; however, in particular, $N_2$ is not necessarily introduced thereinto, and an oxide film with a desired composition can be obtained even in the residual $N_2$ of the atmosphere.

The reason is not known; however, when heat treatment is performed in an $N_2$-containing environment, (Nb, Ti) carbonitrides are produced on the surface of steel material; and therefore, there is a possibility that this promotes the reduction of Fe oxides.

When heat treatment is performed, the content of $N_2$ in an atmosphere is preferably in a range of 0.001% to 0.2%, more preferably in a range of 0.005% to 0.1%.

Heat treatment condition is preferably retained for 5 minutes to 30 minutes at a temperature of 1,000° C. to 1,200° C. so as to form an oxide film where Cr, Si, Nb, Ti and Al are concentrated in a total cationic fraction of 30% or more. A retention temperature is more preferably in a range of 1,050° C. to 1,150° C., and a retention time is more preferably in a range of 10 minutes to 20 minutes.

As such, an oxide film with the above-described cationic fraction can be formed by heat treatment performed when members made of steel material with the above-described chemical composition are brazed. Therefore, a heat treatment step of forming an oxide film with the above-described cationic fraction can be combined with a step of brazing members made of steel material with the above-described chemical composition.

In the case where a part is not manufactured by use of brazing, a heat treatment step may be performed in a $N_2$-containing atmosphere with a pressure of $10^{-2}$ torr to 1 torr for 0.5 minutes to 30 minutes at a temperature of 800° C. to 1,200° C. to form an oxide film with the above-described cationic fraction. In addition, without adding the heat treatment step, conditions of heat treatment by which an oxide film is formed and conditions of pickling treatment by which an oxide film is removed are appropriately adjusted in a step of manufacturing steel material or a part; and thereby, an oxide film with a desired cationic fraction may be formed to simplify manufacturing step and improve productivity.

In the case where an oxide film with the above-described cationic fraction is formed in a step of manufacturing steel material or a part, specifically, a method is cited, for example, where steel material is retained in a mixed gas atmosphere of $N_2$ and $H_2$ with a dew point of −45° C. to −75° C. for 0.5 minutes to 5 minutes at a temperature of 800° C. to 1,100° C. in a final finish annealing step among steps of manufacturing the steel material. In this case, pickling in the post step is omitted.

Herein, an oxide film preferably contains Cr, Si, Nb, Ti and Al in a total cationic fraction of 40% or more to obtain better corrosion resistance. In addition, Cr is the most important among Cr, Si, Nb, Ti and Al, and Cr is preferably included in a cationic fraction (a ratio of the content of Cr to the total content of cations in an oxide film) of 20% or more. The total cationic fraction of Cr, Si, Nb, Ti and Al is more preferably in a range of 50% or more.

In addition, the film thickness of an oxide film is preferably in a range of 15 nm or less, more preferably in a range of 10 nm or less. An increase in the film thickness results in a decrease in the cationic fraction of Cr, Si, Nb, Ti and Al per unit volume, and degradation in corrosion resistance. There is a possibility that (Nb, Ti) carbonitrides produced by heat treatment in an atmosphere containing $N_2$ suppress an increase in the film thickness.

The embodiment is made in light of workability necessary for biofuel supply system parts as a material in addition to the above-described knowledge, and the embodiment provides a ferritic stainless steel for fuel supply system parts having excellent corrosion resistance against biofuels. A summary of the embodiment is as follows.

Hereinafter, descriptions will be made on reasons why each component of a ferritic stainless steel for biofuel supply system parts is specified. A ferritic stainless steel of the embodiment includes a main steel body and an oxide film formed on the surface of the main steel body. Since the thickness of an oxide film is extremely thin compared to the thickness of a main steel body, the composition of steel material before an oxide film is formed is substantially the same as the composition of the main steel body (steel material) after the oxide film is formed. Hereinafter, the composition of a main steel body (steel material) will be described. In the specification, unless otherwise particularly stated, unit "%" indicating the content of component represents mass %.

(C: 0.03% or Less)

Since C deteriorates intergranular corrosion resistance and workability, the content thereof is required to be kept to be small. For this reason, the content of C is set to be in a range of 0.03% or less. However, since the excessive lowering of the content of C increases refining costs, the content of C is preferably set to be in a range of 0.002% or more. The content of C is more preferably in a range of 0.002% to 0.02%.

(N: 0.03% or less)

N is a useful element for pitting corrosion resistance; however, N deteriorates intergranular corrosion resistance and workability. Therefore, the content of N is required to be kept to be small. For this reason, the content of N is set to be in a range of 0.03% or less. However, since the excessive lowering of the content of C increases refining costs, the content of N is preferably set to be in a range of 0.002% or more. The content of N is more preferably in a range of 0.002% to 0.02%.

In addition, the total content of C and N is preferably set to be in a range of 0.015% or more from the viewpoint that grain coarsening during heat treatment is suppressed by carbonitrides and thus decrease in strength is suppressed.

(Si: More than 0.1% and Equal to or Less than 1%)

Si is concentrated in the surface film of stainless steel after heat treatment is completed; and thereby, Si contributes to improvement in corrosion resistance thereof. At least more than 0.1% of Si is required to obtain the effects. In addition, Si is useful as a deoxidation element. However, since excessive addition of Si deteriorates workability, the content of Si is set to be in a range of 1% or less. The content of Si is preferably in a range of more than 0.1% to 0.5% or less.

(Mn: 0.02% to 1.2%)

Mn is a useful element as a deoxidation element, and at least 0.02% or more of Mn is required to be included. However, when Mn is excessively included, corrosion resistance is deteriorated; and therefore, the content of Mn is set to be in a range of 1.2% or less. The content of Mn is preferably in a range of 0.05% to 1%.

(Cr: 15% to 23%)

Cr is a fundamental element for ensuring corrosion resistance against biofuels, and at least 15% or more of Cr is required to be included. The more the content of Cr becomes increased, the better corrosion resistance can be achieved. However, since excessive addition of Cr deteriorates workability and manufacturability, the content of Cr is set to be in a range of 23% or less. The content of Cr is preferably in a range of 17% to 20.5%.

$$8(C+N)+0.03 \leq Nb+Ti \leq 0.6 \quad (1)$$

Each element symbol represents the content (mass %) of the element in Expression (1).

Nb and Ti are useful elements to fix C and N and to improve intergranular corrosion resistance in welded portions. In order to obtain this effect, Nb and Ti are required to be included in such a way that the total content (Nb+Ti) of Nb and Ti becomes 8 times or more the total content (C+N) of C and N. In addition, Nb and Ti are concentrated in the surface film of stainless steel after heat treatment is completed; and thereby, Nb and Ti contribute to improvement in corrosion resistance. At least 0.03% or more of Nb and/or Ti, which are not fixed to C and N and are in a solid solution state, is required to be included to obtain the effects. Therefore, a lower limit of Nb+Ti is set to be 8(C+N)+0.03%. However, since excessive addition of Nb and/or Ti deteriorates workability and manufacturability, an upper limit of Nb+Ti is set to be 0.6%. Nb+Ti is preferably in a range of {10(C+N)+0.031}% to 0.6%.

Here, among Nb and Ti, Ti is concentrated in the surface film of stainless steel; and thereby, Ti contributes to improvement in corrosion resistance. However, Ti has an action on inhibiting brazeability. The content of Ti is preferably limited in such a manner that the value of Ti−3N becomes in a range of 0.03% or less so as to obtain good brazeability when biofuel supply system parts are manufactured by brazing.

(Al: 0.002% to 0.5%)

Al is concentrated in the surface film of stainless steel after heat treatment is completed; and thereby, Al contributes to improvement in corrosion resistance. 0.002% or more of Al is required to be included to obtain the effects. In addition, since Al has effects such as deoxidation effect, Al is a useful element for refining and Al also has an effect of improving formability. However, since excessive addition of Al deteriorates toughness, the content of Al is set to be in a range of 0.002% to 0.5%. The content of Al is preferably in a range of 0.005% to 0.1%.

(Ni: 2% or Less)

As necessary, 2% or less of Ni may be included to improve corrosion resistance. When the content of Ni is in a range of 0.2% or more, effects are stably obtained. The more the content of Ni becomes increased, the better corrosion resistance can be achieved. However, when a large content of Ni is added, a steel is hardened to deteriorate workability. In addition, since Ni is expensive, the addition of Ni increases costs. Therefore, the content of Ni is preferably in a range of 0.2% to 2%, more preferably in a range of 0.2% to 1.2%.

(Cu: 1.5% or Less)

As necessary, 1.5% or less of Cu may be included to improve corrosion resistance. When the content of Cu is in a range of 0.2% or more, effects are stably obtained. The more the content of Cu becomes increased, the better corrosion resistance can be achieved. However, when a large amount of Cu is added, a steel is hardened to deteriorate workability. Therefore, the content of Cu is preferably in a range of 0.2% to 1.5%, more preferably in a range of 0.2% to 0.8%.

(Mo: 3% or Less)

As necessary, 3% or less of Mo may be included to improve corrosion resistance. When the content of Mo is in a range of 0.3% or more, effects are stably obtained. The more the content of Mo becomes increased, the better corrosion resistance can be achieved. However, when a large amount of Mo is added, a steel is hardened to deteriorate workability. In addition, since Mo is expensive, the addition of Mo increases costs. Therefore, the content of Mo is preferably in a range of 0.3% to 3%, more preferably in a range of 0.5% to 2.0%.

(Sn: 0.5% or Less)

As necessary, 0.5% or less of Sn may be included to improve corrosion resistance. When the content of Sn is in a range of 0.01% or more, effects are stably obtained. The more the content of Sn becomes increased, the better corrosion resistance can be achieved. However, when a large content of Sn is added, a steel is hardened to deteriorate workability. Therefore, the content of Sn is preferably in a range of 0.01% to 0.5%, more preferably in a range of 0.05% to 0.4%.

(V: 1% or Less)

As necessary, 1% or less of V may be included to improve corrosion resistance. When the content of V is in a range of 0.05% or more, effects are stably obtained. However, excessive addition of V deteriorates workability. In addition, since V is expensive, the addition of V increases costs. Therefore, the content of V is preferably in a range of 0.05% to 1%.

(W: 1% or Less)

As necessary, 1% or less of W may be included to improve corrosion resistance. When the content of W is in a range of 0.3% or more, effects are stably obtained. However, excessive addition of W deteriorates workability. In addition, since W is expensive, the addition of W increases costs. Therefore, the content of W is preferably in a range of 0.3% to 1%.

(B: 0.005% or Less)

As necessary, 0.005% or less of B may be included to improve workability, particularly, secondary workability. The content of B is preferably in a range of 0.0001% or more to stably obtain effects. The content of B is more preferably in a range of 0.0002% to 0.001%.

(Zr: 0.5% or Less)

As necessary, 0.5% or less of Zr may be included to improve corrosion resistance. The content of Zr is preferably in a range of 0.05% or more to stably obtain effects.

(Co: 0.2% or Less)

As necessary, 0.2% or less of Co may be included to improve secondary workability and toughness. The content of Co is preferably in a range of 0.02% or more to stably obtain effects.

(Mg: 0.002% or Less)

Since Mg has effects such as deoxidation effect, Mg is a useful element for refining. In addition, Mg makes the texture (structure) of a steel fine and Mg has effects of improving workability and toughness. For this reason, as necessary, 0.002% or less of Mg may be included. The content of Mg is preferably in a range of 0.0002% or more to stably obtain effects.

(Ca: 0.002% or Less)

Since Ca has effects such as deoxidation effect, Ca is a useful element for refining. For this reason, as necessary, 0.002% or less of Ca may be included. The content of Ca is preferably in a range of 0.0002% or more to stably obtain effects.

(REM: 0.01% or Less)

Since REM has effects such as deoxidation effect, REM is a useful element for refining. For this reason, as necessary, 0.01% or less of REM may be included. The content of REM is preferably in a range of 0.001% or more to stably obtain effects.

In regard to P among unavoidable impurities, the content of P is preferably in a range of 0.04% or less from the viewpoint of weldability, and the content of P is more preferably in a range of 0.035% or less. In addition, the content of S is preferably in a range of 0.02% or less from the viewpoint of corrosion resistance, and the content of S is more preferably in a range of 0.01% or less.

Stainless steel of the embodiment is manufactured, for example, by the following method.

A molten steel with the above-described chemical composition is produced in a converter or an electric furnace, the molten steel is refined in an AOD furnace, a VOD furnace or the like, and then a billet is produced by a continuous casting method or an ingot-making method. Steps of hot rolling-annealing-pickling-cold rolling-finish annealing-pickling are performed on the billet. Thereafter, a heat treatment step is performed in a vacuum atmosphere containing $N_2$ with a vacuum of $10^{-2}$ torr to 1 torr or in an $H_2$ atmosphere containing $N_2$ for 0.5 minutes to 30 minutes at a temperature of 800° C. to 1,200° C. Thereby, an oxide film with the above-described cationic fraction is formed. As necessary, annealing of a hot-rolled steel sheet may be omitted, and steps of cold rolling-finish annealing-pickling may be repeatedly performed. Examples of the shape of a product include a sheet, a pipe, a bar and a wire.

Stainless steel of the embodiment, as described above, may be manufactured by a method where the above-described heat treatment step is performed after steps of cold rolling-finish annealing-pickling are completed. However, stainless steel of the embodiment may be manufactured by a method where a heat treatment step is performed at another step of a manufacturing step.

Subsequently, biofuel supply system parts of the embodiment will be described.

Biofuel supply system parts of the embodiment are made of stainless steel of the embodiment.

Biofuel supply system parts of the embodiment are preferably manufactured by a method where a step of forming members with the above-described chemical composition and the above-described heat treatment step are performed. In regard to a method of manufacturing biofuel supply system parts of the embodiment, a heat treatment step may be performed before steel is processed to form the shape of a part, and may be performed after steel is processed to form the shape of a part. In the case where a heat treatment step is performed after steel is processed to form the shape of a part, there is no concern that an oxide film is removed from the surface of steel when the steel is processed to form the shape of a part. Therefore, corrosion resistance is not deteriorated, and this case is preferable.

In addition, a heat treatment step is preferably combined with a step of brazing members. In this case, biofuel supply system parts can be efficiently manufactured compared to the case where a heat treatment step is performed independently from a brazing step.

Biofuel supply system parts of the embodiment are made of stainless steel of the embodiment, and the biofuel supply system parts are not limited to the parts made by brazing.

Second Embodiment

In the case where a ferritic stainless steel is used for an exhaust heat recovery unit, corrosion damage is necessarily considered similar to the case where the ferritic stainless steel is used for members in the downstream of an exhaust system including a muffler as a main body. The corrosion damage is critical and is a penetration due to pitting and crevice corrosion. Similar to members in the downstream of an exhaust system where a muffler is a main body, it is required that the leakage of internal fluid due to a penetration is prevented even in an exhaust heat recovery unit. Furthermore, since the leakage of not only exhaust gas but also coolant has to be prevented in an exhaust heat recovery unit, the exhaust heat recovery unit is required to have better corrosion resistance than a muffler and the like. In addition, there is a need for making a heat exchange section thin for the purpose of thermal efficiency improvement, and excellent corrosion resistance is required in this regard.

An exhaust gas-side of the heat exchange section of an exhaust heat recovery unit is required to have corrosion resistance against condensate water in exhaust gas. As fuel becomes diversified, condensate water in exhaust gas becomes diversified, amounts of chloride ions and sulfate-based ions ($SO_3^{2-}$, $SO_4^{2-}$) increase which greatly affect corrosive resistance, pH is changed from neutrality to weak acidity; and therefore, corrosion environment becomes severe.

In light of such a background, the inventors intensively examined improvement in corrosion resistance of stainless steel against condensate water in exhaust gas.

As a result, it was found that the following (1) and (2) were necessarily combined to improve corrosion resistance against pitting and crevice corrosion and obtain stainless steel with excellent corrosion resistance.

(1) It is effective that Ni, Cu and Mo are included, and two or more elements selected from Ni, Cu and Mo are included.

(2) A film formed on the surface of steel when brazing is performed is an oxide film which contains Cr, Si, Nb, Ti and Al in a total cationic fraction ({(the total content of Cr, Si, Nb, Ti and Al included in an oxide film)/(the total content of cationic elements included in an oxide film)}×100(%)) of 40% or more.

Improvement in consideration of both of occurrence and growth of corrosion is effective in improving corrosion resistance against pitting and crevice corrosion of stainless steel.

First, it is effective that Cr is included to suppress occurrence of corrosion. When Cr is appropriately included in stainless steel, a passive film (oxide film) is formed which is rich in Cr in the surface.

Furthermore, when brazing is performed in an environment having a low oxygen partial pressure such as a vacuum or a hydrogen atmosphere, elements such as Nb, Si and Al included in steel material are concentrated in a passive film, and an oxide film is formed which is rich in Cr, Si, Nb, Ti and Al in the surface. The inventors found that in the case where an oxide film formed on the surface of stainless steel included these elements in a total cationic fraction of 40% or more, corrosion resistance against condensate water in exhaust gas, particularly the suppression of the occurrence of corrosion was effectively achieved.

The chemical composition of steel material is required to satisfy Expression (4) illustrated below to form such an oxide film.

$$Si+Cr+Al+\{Nb+Ti-8(C+N)\}\geq 17.5 \quad (4)$$

Each element symbol represents the content (mass %) of the element in Expression (4). In addition, the value of Nb+Ti−8(C+N) is equal to or greater than 0.

The entireties of Nb and/or Ti included in stainless steel are not present in a solid solution state, and portions thereof are present in a state where the portions are fixed to C and N. Among Nb and/or Ti included in stainless steel, Nb, which is not fixed to C and N and is in a solid solution state, is concentrated in a passive film (oxide film) when brazing is performed. Nb contributes to the prevention of corrosion in an oxide film formed by brazing. Among Nb and/or Ti included in stainless steel, the content of Nb and/or Ti, which are fixed to C and N and do not turn into a solid solution state, is considered to be approximately 8 times the total content (C+N) of C and N, when considering ratios of an atomic mass of Nb of 93, an atomic mass of C of 12 and an atomic mass of N of 14. Therefore, it is necessary to set the total content of Si, Cr, Al and {Nb+Ti−8(C+N)} included in stainless steel to be in a range of 17.5% or more so as to form the oxide film which suppresses occurrence of corrosion.

On the other hand, heat treatment being retained in a vacuum atmosphere containing $N_2$ with a vacuum of $10^{-2}$ torr to 1 torr (atmosphere with reduced pressure) or in an $H_2$ atmosphere containing $N_2$ for 0.5 minutes to 30 minutes at a temperature of 1,000° C. to 1,200° C., is preferred as a condition of heat treatment by which the oxide film is fonned when brazing is performed. The total cationic fraction of Cr, Si, Nb, Ti and Al in a formed oxide film does not reach the desired cationic fraction only by heat treatment in a vacuum of $10^{-2}$ torr or less. For example, an atmosphere is vacuumed to $10^{-2}$ torr or less and then $N_2$ is introduced thereinto to set a pressure to be in a range of $10^{-2}$ torr to 1 torr. When heat treatment is performed in such an atmosphere, it is possible to form an oxide film where Cr, Si, Nb, Ti and Al are concentrated in a total cationic fraction of 40% or more. On the other hand, in particular, $N_2$ is not necessarily introduced into an $H_2$ atmosphere, and an oxide film with a desired composition can be obtained even in the residual $N_2$ of the atmosphere.

The reason is not known; however, when heat treatment is performed in an $N_2$-containing environment, (Nb, Ti) carbonitrides are produced on the surface of steel material; and therefore, there is a possibility that this promotes the reduction of Fe oxides.

When heat treatment is performed, the content of $N_2$ in an atmosphere is preferably in a range of 0.001% to 0.2%, more preferably in a range of 0.005% to 0.1%.

Heat treatment condition is preferably retained for 5 minutes to 30 minutes at a temperature of 1,050° C. to 1,150° C. so as to form an oxide film where Cr, Si, Nb, Ti and Al are concentrated in a total cationic fraction of 40% or more. A retention time is more preferably in a range of 10 minutes to 20 minutes.

As such, an oxide film with the above-described cationic fraction can be formed by heat treatment performed when members made of steel material with the above-described chemical composition are brazed. Therefore, a heat treatment step of forming an oxide film with the above-described cationic fraction can be combined with a step of brazing members made of steel material with the above-described chemical composition.

In the case where brazing method is not used, a heat treatment step may be performed in a $N_2$-containing environment with a pressure of $10^{-2}$ torr to 1 torr for 0.5 minutes to 30 minutes at a temperature of 800° C. to 1,200° C. to form an oxide film with the above-described cationic fraction. In addition, without adding the heat treatment step, conditions of heat treatment by which an oxide film is formed and conditions of pickling treatment by which an oxide film is removed are appropriately adjusted in a step of manufacturing steel material or a part; and thereby, an oxide film with a desired cationic fraction may be formed to simplify manufacturing step and improve productivity.

In the case where an oxide film with the above-described cationic fraction is formed in a step of manufacturing steel material or a part, specifically, a method is cited, for example, where steel material is retained in a mixed gas atmosphere of $N_2$ and $H_2$ with a dew point of −45° C. to −75° C. for 0.5 minutes to 5 minutes at a temperature of 800° C. to 1,100° C. in a final finish annealing step among steps of manufacturing the steel material. In this case, pickling in the post step is omitted.

Cr is the most important among Cr, Si, Nb, Ti and Al included in an oxide film, and Cr is preferably included in a cationic fraction (a ratio of the content of Cr to the total content of cations in an oxide film) of 20% or more. The total cationic fraction of Cr, Si, Nb, Ti and Al is more preferably in a range of 50% or more.

In addition, the film thickness of an oxide film is preferably in a range of 15 nm or less, more preferably in a range of 10 nm or less. An increase in the film thickness results in a decrease in the cationic fraction of Cr, Si, Nb, Ti and Al per unit volume, and degradation in corrosion resistance. There is a possibility that (Nb, Ti) carbonitrides produced by heat treatment in an atmosphere containing $N_2$ suppress an increase in the film thickness.

On the other hand, the inventors paid attention to Ni, Cu and Mo from the viewpoint of corrosion-growth suppression effect. In the case where stainless steel contains two or more elements selected from among Ni, Cu and Mo, corrosion resistance is improved. The reasons are estimated as follows.

When corrosion occurs, chlorides are concentrated in pits or crevices and pH is decreased. In many cases in such an environment, active dissolution of material proceeds; however, all of Ni, Cu and Mo are effective in reducing an active dissolution rate. In addition, since an exhaust heat recovery unit is used in an environment where moistening and drying are alternately repeated, corrosion repeatedly and alternately progresses and stops. In this case, when progress of corrosion is prone to be stopped (steel is prone to be re-passivated) and corrosion is not prone to be redeveloped, corrosion resistance is effectively obtained. It is considered that a degree of stopping progress of corrosion (re-passivation) is influenced by dissolution reaction (anodic reaction) and cathodic reaction. It is considered that Ni and Cu, which are effective in promoting cathode reaction, contribute to the promotion of re-passivation. Herein, it is considered that Ni contributes to the promotion of re-passivation mainly by increasing cathode current. In addition, it is considered that Cu contributes to the promotion of re-passivation by working to set electrode potential to be noble. On the other hand, Mo intensifies passivation and has an effect of suppressing corrosion from being redeveloped. It is estimated that corrosion resistance of stainless steel is improved by the combination of different effects of Ni, Cu and Mo.

In light of thermal fatigue characteristics and workability necessary for a member of an exhaust heat recovery unit in addition to the above-described knowledge of corrosion resistance, the embodiment provides a ferritic stainless steel for the exhaust heat recovery unit having excellent corrosion resistance against condensate water in exhaust gas. A summary of the embodiment is as follows.

Hereinafter, descriptions will be made on reasons why each component of a ferritic stainless steel for an exhaust heat recovery unit is specified. A ferritic stainless steel of the embodiment includes a main steel body and an oxide film formed on the surface of the main steel body. Since the thickness of an oxide film is extremely thin compared to the thickness of the main steel body, the composition of steel material before an oxide film is formed is substantially the same as the composition of the main steel body (steel material) after the oxide film is formed. Hereinafter, the composition of the main steel body (steel material) will be described. In the specification, unless otherwise particularly stated, unit "%" indicating the content of component represents mass %.

(C: 0.03% or Less)

Since C deteriorates intergranular corrosion resistance and workability, the content thereof is required to be kept to be small. For this reason, the content of C is set to be in a range of 0.03% or less. However, since the excessive lowering of the content of C increases refining costs, the content of C is preferably set to be in a range of 0.002% or more. The content of C is more preferably in a range of 0.002% to 0.02%.

(N: 0.05% or Less)

N is a useful element for pitting corrosion resistance; however, N deteriorates intergranular corrosion resistance and workability. Therefore, the content of N is required to be kept to be small. For this reason, the content of N is set to be in a range of 0.05% or less. However, since the excessive lowering of the content of C increases refining costs, the content of N is preferably set to be in a range of 0.002% or more. The content of N is more preferably in a range of 0.002% to 0.02%.

Furthermore, the total content of C and N is preferably set to be in a range of 0.015% or more ($(C+N) \geq 0.015\%$) from the viewpoint that grain coarsening during brazing is suppressed.

(Si: More than 0.1% and Equal to or Less than 1%)

Si is concentrated in the surface film of stainless steel after brazing is completed and; and thereby, Si contributes to improvement in corrosion resistance thereof. 0.1% or more of Si is required to obtain the effects. In addition, Si is useful as a deoxidation element. However, since excessive addition of Si deteriorates workability, the content of Si is set to be in a range of 1% or less. The content of Si is more preferably in a range of more than 0.1% to 0.5% or less.

(Mn: 0.02% to 1.2%)

Mn is a useful element as a deoxidation element, and at least 0.02% or more of Mn is required to be included. However, when Mn is excessively included, corrosion resistance is deteriorated; and therefore, the content of Mn is set to be in a range of 1.2% or less. The content of Mn is preferably in a range of 0.05% to 1%.

(Cr: 17% to 23%)

Cr is a fundamental element for ensuring corrosion resistance against condensate water in exhaust gas and salt corrosion resistance, and at least 17% or more of Cr is required to be included. The more the content of Cr becomes increased, the better corrosion resistance can be achieved. However, a large amount of Cr is necessarily added to obtain the effects equivalent to the effects of Ni, Cu and Mo in terms of corrosion resistance in crevice portions. In addition, since excessive addition of Cr deteriorates workability and manufacturability, the content of Cr is set to be in a range of 23% or less. The content of Cr is preferably in a range of 17% to 20.5%.

(Al: 0.002% to 0.5%)

Al is concentrated in the surface film of stainless steel after brazing is completed, and; and thereby, Al contributes to improvement in corrosion resistance. 0.002% or more of Al is required to be included to obtain the effects. In addition, since Al has effects such as deoxidation effect, Al is a useful element for refining and Al also has an effect of improving formability. However, since excessive addition of Al deteriorates toughness, the content of Al is set to be in a range of 0.002% to 0.5%. The content of Al is preferably in a range of 0.003% to 0.1%.

In the embodiment, stainless steel is required to contain two or three elements selected from a group consisting of Ni, Cu and Mo.

(Ni: 0.25% to 1.5%)

Along with Cu and Mo, Ni is an important element for improving corrosion resistance, in particular, perforation resistance (corrosion resistance). In the case where either one of Cu or Mo is included and the content of Ni is in a range of 0.25% or more, effects are stably obtained. The more the content of Ni becomes increased, the better corrosion resistance can be achieved. However, when a large amount of Ni is added, a steel is hardened to deteriorate workability. In addition, since Ni is expensive, the addition of Ni increases costs. Therefore, the content of Ni is set to be in a range of 1.5% or less. The content of Ni is preferably in a range of 0.25% to 1.2%, more preferably in a range of 0.25% to 0.6%.

(Cu: 0.25% to 1%)

Along with Ni and Mo, Cu is an important element for improving corrosion resistance, in particular, perforation resistance (corrosion resistance). In the case where either one of Ni or Mo is included and the content of Cu is in a range of 0.25% or more, effects are stably obtained. The more the content of Cu becomes increased, the better corrosion resistance can be achieved. However, when a large amount of Cu is added, a steel is hardened to deteriorate workability. Therefore, the content of Cu is set to be in a range of 1% or less. The content of Cu is preferably in a range of 0.25% to 0.8%, more preferably in a range of 0.25% to 0.6%.

(Mo: 0.5% to 2%)

Along with Ni and Cu, Mo is an important element for improving corrosion resistance, in particular, perforation resistance (corrosion resistance). In the case where either one of Ni or Cu is included and the content of Mo is in a range of 0.5% or more, effects are stably obtained. The more the content of Mo becomes increased, the better corrosion resistance can be achieved. However, when a large amount of Mo is added, a steel is hardened to deteriorate workability. In addition, since Mo is expensive, the addition of Mo increases costs. Therefore, the content of Mo is set to be in a range of 2% or less. As described above, since Mo improves corrosion resistance with actions different from those of Ni and Cu, Mo is more important element. For this reason, the content of Mo is preferably in a range of 0.7% to 2%, more preferably in a range of 0.9% to 2%.

$$8(C+N)+0.03 \leq Nb+Ti \leq 0.6 \quad (3)$$

Each element symbol represents the content (mass %) of the element in Expression (3).

Nb and Ti are useful elements to fix C and N and to improve intergranular corrosion resistance in welded portions. In order to obtain this effect, Nb and Ti are required to be included in such a way that the total content (Nb+Ti) of Nb and Ti becomes 8 times or more the total content (C+N) of C and N. In addition, Nb and Ti are concentrated in the surface film of stainless steel after brazing is completed; and thereby, Nb and Ti contribute to improvement in corrosion resistance. At least 0.03% or more of Nb and/or Ti, which are not fixed to C and N and are in a solid solution state, is required to be included to obtain the effects. Therefore, a lower limit of Nb+Ti is set to be 8(C+N)+0.03%.

However, since excessive addition of Nb and/or Ti deteriorates workability and manufacturability, an upper limit of Nb+Ti is set to be 0.6%. Nb+Ti is preferably in a range of {10(C+N)+0.03}% to 0.6%.

Here, among Nb and Ti, Ti is concentrated in the surface film of stainless steel; and thereby, Ti contributes to improvement in corrosion resistance. However, Ti has an action on inhibiting brazeability. The content of Ti is preferably limited in such a manner that the value of Ti−3N becomes in a range of 0.03% or less so as to obtain good brazeability is obtained. On the other hand, Nb has an action on improving high-temperature strength. Since an exhaust heat recovery unit cools high-temperature exhaust gas, the exhaust heat recovery unit is required to have thermal fatigue characteristics. In the case where stainless steel is used for members which require such a thermal fatigue characteristics, the stainless steel preferably contains Nb.

(V: 0.5% or Less)

As necessary, 0.5% or less of V may be included to improve corrosion resistance. When the content of V is in a range of 0.05% or more, effects are stably obtained. However, excessive addition of V deteriorates workability. In addition, since V is expensive, the addition of V increases costs. Therefore, the content of V is preferably in a range of 0.05% to 0.5%.

(W: 1% or Less)

As necessary, 1% or less of W may be included to improve corrosion resistance. When the content of W is in a range of 0.3% or more, effects are stably obtained. However, excessive addition of W deteriorates workability. In addition, since W is expensive, the addition of W increases costs. Therefore, the content of W is preferably in a range of 0.3% to 1%.

(B: 0.005% or Less)

As necessary, 0.005% or less of B may be included to improve workability, particularly, secondary workability. The content of B is preferably in a range of 0.0001% or more to stably obtain effects. The content of B is more preferably in a range of 0.0002% to 0.0015%.

(Zr: 0.5% or Less)

As necessary, 0.5% or less of Zr may be included to improve corrosion resistance. The content of Zr is preferably in a range of 0.05% or more to stably obtain effects.

(Sn: 0.5% or Less)

As necessary, 0.5% or less of Sn may be included to improve corrosion resistance. The content of Sn is preferably in a range of 0.01% or more to stably obtain effects.

(C: 0.2% or Less)

As necessary, 0.2% or less of Co may be included to improve secondary workability and toughness. The content of Co is preferably in a range of 0.02% or more to stably obtain effects.

(Mg: 0.002% or Less)

Since Mg has effects such as deoxidation effect, Mg is a useful element for refining. In addition, Mg makes the texture (structure) of a steel fine and Mg has effects of improving workability and toughness. For this reason, as necessary, 0.002% or less of Mg may be included. The content of Mg is preferably in a range of 0.0002% or more to stably obtain effects.

(Ca: 0.002% or Less)

Since Ca has effects such as deoxidation effect, Ca is a useful element for refining. For this reason, as necessary, 0.002% or less of Ca may be included. The content of Ca is preferably in a range of 0.0002% or more to stably obtain effects.

(REM: 0.01% or Less)

Since REM has effects such as deoxidation effect, REM is a useful element for refining. For this reason, as necessary, 0.01% or less of REM may be included. The content of REM is preferably in a range of 0.001% or more to stably obtain effects.

In regard to P among unavoidable impurities, the content of P is preferably in a range of 0.04% or less from the viewpoint of weldability, and the content of P is more preferably in a range of 0.035% or less. In addition, the content of S is preferably in a range of 0.02% or less from the viewpoint of corrosion resistance, and the content of S is more preferably in a range of 0.01% or less.

Stainless steel of the embodiment is manufactured, for example, by the following method.

A molten steel with the above-described chemical composition is produced in a converter or an electric furnace, the molten steel is refined in an AOD furnace, a VOD furnace or the like, and then a billet is produced by a continuous casting method or an ingot-making method. Steps of hot rolling-annealing of hot-rolled steel sheet-pickling-cold rolling-finish annealing-pickling are performed on the billet. Thereafter, a heat treatment step is performed in a vacuum atmosphere containing $N_2$ with a vacuum of $10^{-2}$ torr to 1 torr or in an $H_2$ atmosphere containing $N_2$ for 0.5 minutes to 30 minutes at a temperature of 800° C. to 1,200° C. Thereby, an oxide film with the above-described cationic fraction is formed. The above-described heat treatment step can be combined with a step of brazing members made of steel material with the above-described chemical composition. As necessary, annealing of a hot rolled steel sheet may be omitted, and steps of cold rolling-finish annealing-pickling may be repeatedly performed. Examples of the shape of a product include a sheet, a pipe, a bar and a wire.

Subsequently, an exhaust heat recovery unit of the embodiment will be described.

An exhaust heat recovery unit includes a heat exchange section of which the members are fabricated by brazing. The heat exchange section is made of a ferritic stainless steel of the embodiment, and the ferritic stainless steel has chemical composition described above, and an oxide film is formed on a surface thereof and the oxide film contains Cr, Si, Nb, Ti and Al in a total cationic fraction of 40% or more.

A method for manufacturing an exhaust heat recovery unit of the embodiment includes: a step of forming members with the chemical composition of the embodiment according to general processing step; and a step of fabricating the members. In the step of fabricating the members, it is preferable that the members are subjected to heat treatment and brazing in a vacuum atmosphere containing $N_2$ with a vacuum of $10^{-2}$ torr to 1 torr or in an $H_2$ atmosphere containing $N_2$. When such a fabrication step is performed, an oxide film is formed on the surface of a member made of a ferritic stainless steel, and the oxide film contains Cr, Si, Nb, Ti and Al in a total cationic fraction of 40% or more. As such, a heat exchange section of the embodiment is obtained.

Brazing joint is not necessarily used (applied) in a step of fabricating members. In this case, a ferritic stainless steel of the embodiment having an oxide film thereon is processed to form the shape of a part. Thereby, members are formed. Subsequently, a heat exchange section is obtained by fabricating the members.

EXAMPLES

Hereinafter, effects of the embodiments are made clearer according to Examples. The embodiments are not limited to the following Examples, and modifications can be appropriately made and implemented without departing from the features of the invention.

Example 1

Molten steels (150 kg) with compositions illustrated in Tables 1 and 2 were melted in a vacuum melting furnace to cast 50 kg of steel ingots and produce billets. Then the billets were subjected to hot rolling at a heating temperature of 1,200° C. to obtain hot-rolled steel sheets with a thickness of 4 mm. Next, the hot-rolled steel sheets were subjected to annealing at a temperature of 850° C. to 950° C. Then scales were removed by shot blasting and pickling in a nitric hydrofluoric acid solution (mixed solution of nitric acid and hydrofluoric acid). Next, the steel sheets were subjected to cold rolling to have a thickness of 2 mm. For the second time, intermediate annealing was performed in the same temperature range as that of the annealing of the hot-rolled steel sheets. Then pickling was performed under the same conditions to remove scales. Next, the steel sheets were subjected to cold rolling to have a thickness of 0.8 mm. Thereafter, the steel sheets were subjected to finish annealing at a temperature of 880° C. to 1,000° C. to obtain cold-rolled steel sheets of materials No. 1-A to 1-N.

In Tables 1 and 2, underlined values are out of the range of the embodiments.

(Corrosion Test 1)

Test specimens with width (W) 25 mm×length (L) 100 mm were cut out from the cold-rolled steel sheets of materials No. 1-A to 1-N, the entire surfaces of the test specimens were subjected to wet polishing using an emery paper of up to #320.

Subsequently, the test specimens of materials No. 1-A to 1-N were subjected to heat treatment under the following condition 1-1 to obtain test specimens No. 1-1 to 1-10, 1-101 to 1-103, 1-106 and 1-201 to 1-203 in Table 3.

(Condition 1-1)

The test specimens were placed in a heating furnace. The furnace was vacuumed to $10^{-3}$ torr and then $N_2$ was introduced thereinto to set a pressure to be in a range of 10 torr to $10^{-2}$ torr. The test specimens were heated in this atmosphere and retained for 10 minutes at 1,100° C. The test specimens were cooled down to room temperature in the furnace. A pressure in the furnace was retained in a range of $10^{1}$ torr to $10^{-2}$ torr while temperature was raised and retained at 1,100° C.

In addition, the test specimens of materials No. 1-D, 1-F and 1-J were subjected to heat treatment under the following condition 1-2 to obtain test specimens No. 1-11 to 1-13 in Table 3.

(Condition 1-2)

The test specimens were heated in 100% of $H_2$ with a dew point of −65° C. and retained for 10 minutes at 1,100° C.

TABLE 1

| Classification | Material No. | Chemical Composition (mass %) C | N | Si | Mn | P | S | Cr | Nb | Ti | Al | Ni | Cu | Cr + Si + Al + (Nb + Ti − 8(C + N)) |
|---|---|---|---|---|---|---|---|---|---|---|---|---|---|---|
| Comparative Example | 1-A | 0.0025 | 0.0076 | 0.45 | 0.31 | 0.02 | 0.007 | 11.06 | 0 | 0.25 | 0.07 | — | — | 11.7 |
| | 1-B | 0.0029 | 0.0081 | 0.22 | 0.22 | 0.02 | 0.001 | 13.01 | 0.45 | 0 | 0.06 | — | — | 13.7 |
| | 1-C | 0.0031 | 0.0082 | 0.21 | 0.22 | 0.02 | 0.002 | 14.59 | 0 | 0.22 | 0.06 | — | — | 15.0 |
| | 1-N | 0.0034 | 0.0080 | 0.12 | 0.25 | 0.03 | 0.005 | 15.05 | 0 | 0.11 | 0.04 | — | — | 15.2 |
| Invention Example | 1-D | 0.0032 | 0.0078 | 0.42 | 0.26 | 0.02 | 0.002 | 15.11 | 0.41 | 0 | 0.06 | — | — | 15.9 |
| | 1-E | 0.0021 | 0.0106 | 0.23 | 0.24 | 0.02 | 0.001 | 16.11 | 0.22 | 0.18 | 0.06 | — | — | 16.7 |
| | 1-F | 0.0024 | 0.0079 | 0.16 | 0.21 | 0.02 | 0.001 | 17.02 | 0.42 | 0 | 0.06 | — | — | 17.6 |
| | 1-G | 0.0035 | 0.0081 | 0.19 | 0.23 | 0.02 | 0.002 | 19.07 | 0 | 0.23 | 0.05 | — | — | 19.5 |
| | 1-H | 0.0024 | 0.0071 | 0.21 | 0.23 | 0.02 | 0.002 | 20.34 | 0.25 | 0 | 0.02 | — | — | 20.7 |
| | 1-I | 0.0029 | 0.0081 | 0.21 | 0.21 | 0.02 | 0.002 | 22.45 | 0.35 | 0.23 | 0.07 | — | — | 23.2 |
| | 1-J | 0.0024 | 0.0079 | 0.16 | 0.21 | 0.02 | 0.001 | 17.02 | 0.37 | 0 | 0.06 | — | — | 17.5 |
| | 1-K | 0.0025 | 0.0078 | 0.16 | 0.21 | 0.02 | 0.001 | 17.11 | 0.37 | 0 | 0.04 | 0.31 | — | 17.6 |
| | 1-L | 0.0024 | 0.0079 | 0.16 | 0.21 | 0.02 | 0.001 | 17.01 | 0.36 | 0 | 0.05 | 0.31 | 0.29 | 17.5 |
| | 1-M | 0.0025 | 0.0080 | 0.14 | 0.20 | 0.02 | 0.001 | 17.08 | 0.38 | 0 | 0.05 | — | — | 17.6 |

TABLE 2

| Classification | Material No. | Chemical Composition (mass %) Mo | Sn | V | W | B | Zr | Co | Mg | Ca | REM | Cr + Si + Al + (Nb + Ti − 8(C + N)) |
|---|---|---|---|---|---|---|---|---|---|---|---|---|
| Comparative Example | 1-A | — | — | — | — | — | — | — | — | — | — | 11.7 |
| | 1-B | — | — | — | — | — | — | — | — | — | — | 13.7 |
| | 1-C | — | — | — | — | — | — | — | — | — | — | 15.0 |
| | 1-N | — | — | — | — | — | — | — | — | — | — | 15.2 |
| Invention Example | 1-D | — | — | — | — | — | — | — | — | — | — | 15.9 |
| | 1-E | — | — | 0.11 | — | — | 0.16 | 0.09 | — | — | — | 16.7 |
| | 1-F | — | — | — | — | — | — | — | — | — | — | 17.6 |
| | 1-G | — | — | — | — | 0.0006 | — | — | — | — | 0.002 | 19.5 |
| | 1-H | — | — | — | — | — | — | — | — | — | — | 20.7 |
| | 1-I | — | — | — | 0.56 | — | — | — | 0.0006 | 0.0015 | — | 23.2 |
| | 1-J | 1.21 | — | — | — | — | — | — | — | — | — | 17.5 |
| | 1-K | — | — | — | — | — | — | — | — | — | — | 17.6 |
| | 1-L | — | — | — | — | 0.0005 | — | — | — | — | — | 17.5 |
| | 1-M | — | 0.15 | — | — | — | — | — | — | — | — | 17.6 |

Furthermore, the test specimens of materials No. 1-D and 1-F were also subjected to heat treatment under different conditions for comparison. The test specimen of material No. 1-D was subjected to heat treatment under the following condition 1-3 to obtain test specimen No. 1-104 in Table 3.

(Condition 1-3)

The test specimen was placed in the heating furnace. The furnace was vacuumed to $10^{-3}$ torr. The test specimen was heated in this atmosphere and retained for 10 minutes at 1,100° C. Then the test specimen was cooled down to room temperature in the furnace.

The test specimen of material No. 1-F was subjected to heat treatment under the following condition 1-4 to obtain test specimen No. 1-105 in Table 3.

(Condition 1-4)

The test specimen was heated in the air and retained for 30 minutes at 700° C. Then the test specimen was subjected to air cooling to cool to room temperature.

In Table 3, underlined values are out of the range of the embodiments.

Corrosion tests were performed on the test specimens of No. 1-1 to 1-13, 1-101 to 1-106 and 1-201 to 1-203 in Table 3, using aqueous solutions illustrated in Table 3.

Tests were performed on the test specimens of No. 1-1 to 1-13 and 1-101 to 1-106 using, as test solutions, aqueous solutions where the combined concentrations of formic acid and acetic acid were in a range of 1% to 10% and NaCl was dissolved to set the concentration of Cl ions (chloride ions) to be 100 ppm. Test temperature was set to be 95° C. and test time was set to be 168 hours. For reference, tests were performed on the test specimens of No. 1-201 to 1-203 under the condition where corrosiveness was evaluated using degraded gasoline in the related art. Specifically, the combined concentration of formic acid and acetic acid was set to be in a range of less than 1% and the temperature was set to be 45° C. In the corrosion test 1, other test conditions were conformed to a JASO-M611-92-A.

After the corrosion tests were completed, the test specimens were subjected to derusting treatment using nitric acid, and a corrosion mass loss of each test specimen was measured and the presence of local corrosion was observed.

TABLE 3

| Classification | No. | Material No. | A Value | Formic Acid (%) | Acetic Acid (%) | Formic Acid + Acetic Acid (%) | Chloride Ion (ppm) | Temperature (° C.) | Results of Corrosion Test 1 | Results of Corrosion Test 2 RME | Results of Corrosion Test 2 E22 |
|---|---|---|---|---|---|---|---|---|---|---|---|
| Invention Example | 1-1 | 1-D | 0.320 | 0.1 | 1 | 1.1 | 100 | 95 | Good | Without Corrosion Trace | Without Corrosion Trace |
| | 1-2 | 1-E | 0.34 | 0.1 | 1 | 1.1 | 100 | 95 | Good | Without Corrosion Trace | Without Corrosion Trace |
| | 1-3 | 1-F | 0.45 | 0.1 | 1 | 1.1 | 100 | 95 | Good | Without Corrosion Trace | Without Corrosion Trace |
| | 1-4 | 1-G | 0.52 | 1 | 5 | 6 | 100 | 95 | Good | Without Corrosion Trace | Without Corrosion Trace |
| | 1-5 | 1-H | 0.61 | 5 | 5 | 10 | 100 | 95 | Good | Without Corrosion Trace | Without Corrosion Trace |
| | 1-6 | 1-I | 0.65 | 5 | 5 | 10 | 100 | 95 | Good | Without Corrosion Trace | Without Corrosion Trace |
| | 1-7 | 1-J | 0.42 | 0.1 | 1 | 1.1 | 100 | 95 | Good | Without Corrosion Trace | Without Corrosion Trace |
| | 1-8 | 1-K | 0.44 | 5 | 5 | 10 | 100 | 95 | Good | Without Corrosion Trace | Without Corrosion Trace |
| | 1-9 | 1-L | 0.40 | 1 | 1 | 2 | 100 | 95 | Good | Without Corrosion Trace | Without Corrosion Trace |
| | 1-10 | 1-M | 0.41 | 1 | 5 | 6 | 100 | 95 | Good | Without Corrosion Trace | Without Corrosion Trace |
| | 1-11 | 1-D | 0.35 | 0.1 | 1 | 1.1 | 100 | 95 | Good | Without Corrosion Trace | Without Corrosion Trace |
| | 1-12 | 1-F | 0.49 | 0.1 | 1 | 1.1 | 100 | 95 | Good | Without Corrosion Trace | Without Corrosion Trace |
| | 1-13 | 1-J | 0.46 | 0.1 | 1 | 1.1 | 100 | 95 | Good | Without Corrosion Trace | Without Corrosion Trace |
| Comparative Example | 1-101 | 1-A | 0.19 | 0.1 | 1 | 1.1 | 100 | 95 | Bad | With Corrosion Trace | With Corrosion Trace |
| | 1-102 | 1-B | 0.24 | 0.1 | 1 | 1.1 | 100 | 95 | Bad | With Corrosion Trace | With Corrosion Trace |
| | 1-103 | 1-C | 0.27 | 0.1 | 1 | 1.1 | 100 | 95 | Bad | With Corrosion Trace | With Corrosion Trace |
| | 1-104 | 1-D | 0.22 | 0.1 | 1 | 1.1 | 100 | 95 | Bad | With Corrosion Trace | With Corrosion Trace |
| | 1-105 | 1-F | 0.17 | 0.1 | 1 | 1.1 | 100 | 95 | Bad | With Corrosion Trace | With Corrosion Trace |
| | 1-106 | 1-N | 0.27 | 0.1 | 1 | 1.1 | 100 | 95 | Bad | With Corrosion Trace | With Corrosion Trace |
| Reference Example | 1-201 | 1-A | 0.19 | 0.01 | 0.01 | 0.02 | 100 | 45 | Good | Without Corrosion Trace | Without Corrosion Trace |
| | 1-202 | 1-B | 0.24 | 0.1 | 0.1 | 0.2 | 100 | 45 | Good | Without Corrosion Trace | Without Corrosion Trace |
| | 1-203 | 1-C | 0.27 | 0.1 | 0.5 | 0.6 | 100 | 45 | Good | Without Corrosion Trace | Without Corrosion Trace |

The corrosion mass loss was calculated as follows. First, the mass of a test specimen before and after a test was measured using a direct-reading balance with a measurable scale (measurement limit) of 0.0001 g. A mass loss calculated from the variation of the mass was divided by the surface area of the test specimen before the test; and thereby, the corrosion mass loss was obtained. Local corrosion was observed as follows. The entire surfaces of the test specimen were observed using an optical microscope of 200 magnifications, and the entire surfaces represent all portions including a portion which was in contact with gaseous phase (a portion which was not in contact with aqueous solution), a portion which was in contact with liquid phase (a portion which was in contact with aqueous solution) and a boundary between the gaseous phase and the liquid phase. In addition, when a spot with local corrosion was found, the depth of corrosion in the spot was measured using a focal depth method.

In the case where the corrosion mass loss was in a range of less than 0.5 $g \cdot m^{-2}$ and local corrosion was not noticed, the test result was determined to be a pass (Good). In the case where the corrosion mass loss was in a range of 0.5 $g \cdot m^{-2}$ or more which was equivalent to a detection limit, or in the case where corrosion traces with a depth of corrosion exceeding the detection limit of 10 μm were detected when measured by a focal depth method, the test result was defined as "presence of local corrosion" and determined to be a failure (Bad). The results were illustrated in Table 3.

(Corrosion Test 2)

Two test specimens were cut out from each of cold-rolled steel sheets of materials No. 1-A to 1-N in Tables 1 and 2, and the entire surfaces of the test specimens were subjected to wet polishing using an emery paper of up to #320. Then, each of the test specimens was formed into a cup with an inner diameter of 50 mm and a depth of 35 mm. Heat treatments were performed on the cups under the same conditions as the conditions 1-1 to 1-4 of the corrosion test 1 described above. After the heat treatments were completed, one cup was filled with 45 mL of RME, and the other cup was filled with 45 mL of E22. An aqueous solution, which contained formic acid, acetic acid and chloride ions at the concentrations in Table 3, was prepared in advance, 5 mL of the aqueous solution was added to the two cups, and the cups were sealed in. Then the two cups were put in a temperature-controlled chamber for 168 hours at 95° C. (No. 1-1 to 1-13 and 1-101 to 1-106 in Table 3). Some tests were performed in a temperature-controlled chamber at 45° C., which corresponded to the condition of evaluation of corrosiveness due to degraded gasoline in the related art (No. 1-201 to 1-203 in Table 3). After the test was completed, corrosive liquid was drained, and the interior of the cups was washed with acetone. Thereafter, the presence of corrosion traces was observed by visual inspection. The results were illustrated in Table 3.

(Surface Analysis)

Samples for surface analysis were cut out from cold-rolled steel sheets of materials No. 1-A to 1-N. The samples for surface analysis were subjected to heat treatments under the same conditions as the heat treatment for corrosion test specimens No. 1-1 to 1-13, 1-101 to 1-106 and 1-201 to 1-203 in Table 3. An oxide film on the surface was analyzed by X-ray photoelectron spectroscopy (XPS), and a cationic fraction (A value) in the oxide film was calculated. XPS was performed using mono-AlKα ray as an X-ray source with an X-ray photoelectron spectrometer made by ULVAC-PHI, Inc. under a condition where the beam diameter of X-ray was approximately 100 μm and the output angle thereof was 45 degrees. The results were illustrated in Table 3.

In Table 3, "A value" indicates the total cationic fraction of Cr, Si, Nb, Ti and Al in an oxide film which is represented by the following expression.

$$A \text{ value} = (Cr+Si+Nb+Ti+Al)/(\text{the total content of cations})$$

Since Invention Examples No. 1-1 to 1-13 had compositions within the range of the embodiments, excellent corrosion resistance was exerted in test results illustrated in Table 3.

On the other hand, since Comparative Examples No. 1-101 to 1-103 had the contents of Cr and the values of Si+Cr+ Al+{Nb+Ti−8(C+N)} out of the range of the embodiments, satisfactory corrosion resistance was not obtained. In addition, since Comparative Example No. 1-106 had the value of Si+Cr+Al+{Nb+Ti−8(C+N)} out of the range of the embodiments, satisfactory corrosion resistance was not obtained.

In addition, although the contents of Cr did not satisfy the conditions of the embodiments in Reference Examples No. 1-201 to 1-203, satisfactory corrosion resistance was exerted. This was because the combined concentration of formic acid and acetic acid was in a range of less than 1% and the temperature was 45° C., which was a mild condition.

In addition, the A value was 0.22 in Comparative Example No. 1-104 in which heat treatment was performed without the introduction of $N_2$. In addition, the A value was 0.17 in Comparative Example No. 1-105 in which heat treatment was performed in the air. Both examples had the compositions within the range of the embodiments; however, the A values did not satisfy the range of the embodiments and inferior corrosion resistance was obtained.

Example 2

Molten steels (30 kg) with chemical compositions illustrated in the following Tables 4 and 5 were melted in a vacuum melting furnace to cast 17 kg of flat steel ingots. Then the ingots were subjected to hot rolling at a heating temperature of 1,200° C. to obtain hot-rolled steel sheets with a thickness of 4.5 mm. Next, the hot-rolled steel sheets were subjected to annealing at a temperature of 900° C. to 1,030° C. Next, scales were removed by alumina shot blasting. Then the steel sheets were subjected to cold rolling to have a thickness of 1 mm, and thereafter, the steel sheets were subjected to finish annealing at a temperature of 950° C. to 1,050° C. to obtain cold-rolled steel sheets of Material Examples 2-1 to 2-17. Corrosion resistance was evaluated and a surface film was analyzed using these cold-rolled steel sheets.

In Tables 4 and 5, underlined values are out of the range of the embodiments.

TABLE 4

| | Material Example | Chemical Composition (mass %) C | N | Si | Mn | P | S | Cr | Al | Ni | Cu | Mo | Nb | Ti | Si + Cr + Al + Nb + Ti − 8(C + N) |
|---|---|---|---|---|---|---|---|---|---|---|---|---|---|---|---|
| Invention Example | 2-1 | 0.014 | 0.021 | 0.84 | 0.86 | 0.024 | 0.0006 | 17.18 | 0.003 | 0.42 | 0.26 | — | 0.39 | — | 18.13 |
| Invention Example | 2-2 | 0.012 | 0.018 | 0.42 | 0.15 | 0.028 | 0.0021 | 19.42 | 0.025 | 0.32 | 0.42 | — | 0.38 | — | 20.01 |
| Invention Example | 2-3 | 0.006 | 0.013 | 0.16 | 0.19 | 0.022 | 0.0010 | 19.24 | 0.005 | — | 0.51 | 1.86 | 0.49 | — | 19.74 |
| Invention Example | 2-4 | 0.004 | 0.016 | 0.14 | 0.11 | 0.029 | 0.0011 | 19.05 | 0.013 | 1.12 | — | 1.05 | 0.34 | — | 19.38 |
| Invention Example | 2-5 | 0.005 | 0.014 | 0.48 | 0.14 | 0.024 | 0.0053 | 21.88 | 0.031 | — | 0.42 | 0.78 | 0.33 | — | 22.57 |
| Invention Example | 2-6 | 0.007 | 0.018 | 0.25 | 0.32 | 0.025 | 0.0012 | 18.54 | 0.056 | 0.28 | 0.84 | — | 0.56 | — | 19.21 |
| Invention Example | 2-7 | 0.008 | 0.012 | 0.47 | 0.19 | 0.024 | 0.0011 | 17.32 | 0.043 | 0.33 | 0.42 | 0.53 | 0.38 | — | 18.05 |
| Invention Example | 2-8 | 0.005 | 0.012 | 0.19 | 0.12 | 0.031 | 0.0018 | 22.67 | 0.078 | 0.32 | — | 0.61 | 0.26 | — | 23.06 |
| Invention Example | 2-9 | 0.009 | 0.016 | 0.23 | 0.42 | 0.021 | 0.0005 | 18.12 | 0.021 | 0.34 | — | 0.98 | 0.41 | — | 18.58 |
| Invention Example | 2-10 | 0.008 | 0.015 | 0.25 | 0.36 | 0.025 | 0.0009 | 18.26 | 0.13 | — | 0.45 | 0.68 | 0.29 | — | 18.75 |
| Invention Example | 2-11 | 0.012 | 0.007 | 0.13 | 0.25 | 0.034 | 0.0026 | 22.81 | 0.008 | — | 0.39 | 0.51 | — | 0.25 | 23.05 |
| Invention Example | 2-12 | 0.008 | 0.011 | 0.36 | 0.34 | 0.028 | 0.0011 | 21.67 | 0.016 | 0.33 | — | 0.52 | 0.24 | 0.05 | 22.18 |
| Comparative Example | 2-13 | 0.012 | 0.014 | 0.66 | 0.35 | 0.028 | 0.0011 | 17.16 | 0.023 | — | — | 0.54 | 0.38 | — | 18.02 |
| Comparative Example | 2-14 | 0.013 | 0.015 | 0.64 | 0.36 | 0.027 | 0.0009 | 17.09 | 0.031 | 0.32 | — | — | 0.39 | — | 17.93 |
| Comparative Example | 2-15 | 0.011 | 0.018 | 0.65 | 0.35 | 0.030 | 0.0012 | 17.12 | 0.041 | — | 0.35 | — | 0.41 | — | 17.99 |
| Comparative Example | 2-16 | 0.012 | 0.017 | 0.11 | 0.79 | 0.026 | 0.0011 | 17.04 | 0.003 | 0.26 | 0.29 | — | 0.27 | — | 17.19 |
| Comparative Example | 2-17 | 0.007 | 0.016 | 0.39 | 0.31 | 0.025 | 0.0049 | 15.08 | 0.006 | 0.26 | 0.26 | — | — | 0.19 | 15.48 |

TABLE 5

| | Material Example | Chemical Composition (mass %) V | W | B | Zr | Sn | Co | Mg | Ca | REM | Si + Cr + Al + Nb + Ti − 8(C + N) |
|---|---|---|---|---|---|---|---|---|---|---|---|
| Invention Example | 2-1 | — | — | — | — | — | — | — | — | — | 18.13 |
| Invention Example | 2-2 | — | — | — | — | — | — | — | — | — | 20.01 |
| Invention Example | 2-3 | — | — | — | — | — | — | — | — | — | 19.74 |
| Invention Example | 2-4 | — | — | — | — | 0.12 | — | — | — | — | 19.38 |
| Invention Example | 2-5 | — | — | — | — | — | — | — | — | — | 22.57 |
| Invention Example | 2-6 | 0.16 | — | — | — | — | — | — | — | 0.002 | 19.21 |
| Invention Example | 2-7 | — | — | — | — | — | — | — | — | — | 18.05 |
| Invention Example | 2-8 | 0.12 | — | 0.0008 | — | — | — | — | — | — | 23.06 |
| Invention Example | 2-9 | — | — | 0.0005 | — | — | — | — | — | — | 18.58 |
| Invention Example | 2-10 | — | 0.95 | — | — | — | — | 0.0005 | 0.0012 | — | 18.75 |
| Invention Example | 2-11 | — | — | — | 0.21 | — | 0.08 | — | — | — | 23.05 |
| Invention Example | 2-12 | — | — | — | — | — | — | — | — | — | 22.18 |
| Comparative Example | 2-13 | — | — | — | — | — | — | — | — | — | 18.02 |
| Comparative Example | 2-14 | — | — | — | — | — | — | — | — | — | 17.93 |
| Comparative Example | 2-15 | — | — | — | — | — | — | — | — | — | 17.99 |
| Comparative Example | 2-16 | — | — | — | — | — | — | — | — | — | 17.19 |
| Comparative Example | 2-17 | — | — | — | — | — | — | — | — | — | 15.48 |

Test specimens with width 25 mm×length 100 mm were cut out from the cold-rolled steel sheets of Material Examples 2-1 to 2-17, and the entire surfaces of the test specimens were subjected to wet polishing using an emery paper of up to #320. Heat treatment was performed under the following condition 2-1 which simulated the atmosphere when brazing was performed; and thereby, test specimens of Experimental Examples 2-1 to 2-17 illustrated in Table 6 were obtained.

(Condition 2-1)

The test specimens were placed in a heating furnace. The furnace was vacuumed to $10^{-3}$ torr, and then $N_2$ was introduced thereinto to set a pressure to be in a range of $10^{-1}$ torr to $10^{-2}$ torr. The test specimens were heated in the atmosphere and retained for 10 minutes at 1,100° C. The test specimens were cooled down to room temperature in the furnace. A pressure in the furnace was retained in a range of $10^{-1}$ torr to $10^{-2}$ torr while the temperature was raised and retained at 1,100° C.

In addition, test specimen of Material Example 2-1 was subjected to heat treatment under the following condition 2-2 to obtain test specimen of Experimental Example 2-18 in Table 6.

(Condition 2-2)

The test specimen was placed in the heating furnace. The furnace was vacuumed to $10^{-3}$ torr. The test specimen was heated in this atmosphere and retained for 10 minutes at 1,100° C. Then the test specimen was cooled down to room temperature in the furnace.

Furthermore, test specimens of Material Examples 2-1 to 2-3 were subjected to heat treatment under the following condition 2-3 to obtain Experimental Examples 2-19 to 2-21 in Table 6.

(Condition 2-3)

The test specimens were heated in 100% of $H_2$ with a dew point of −65° C. and retained for 10 minutes at 1,100° C.

TABLE 6

| Steel Sheet | Experimental Example | Material Example | A' Value | Maximum Depth of Corrosion (μm) |
|---|---|---|---|---|
| Invention Example | 2-1 | 2-1 | 0.43 | 298 |
| Invention Example | 2-2 | 2-2 | 0.65 | 290 |
| Invention Example | 2-3 | 2-3 | 0.54 | 168 |
| Invention Example | 2-4 | 2-4 | 0.49 | 212 |
| Invention Example | 2-5 | 2-5 | 0.73 | 276 |
| Invention Example | 2-6 | 2-6 | 0.63 | 292 |
| Invention Example | 2-7 | 2-7 | 0.47 | 253 |
| Invention Example | 2-8 | 2-8 | 0.78 | 198 |
| Invention Example | 2-9 | 2-9 | 0.45 | 245 |
| Invention Example | 2-10 | 2-10 | 0.64 | 284 |
| Invention Example | 2-11 | 2-11 | 0.57 | 275 |
| Invention Example | 2-12 | 2-12 | 0.51 | 225 |
| Comparative Example | 2-13 | 2-13 | 0.44 | 478 |
| Comparative Example | 2-14 | 2-14 | 0.45 | 445 |
| Comparative Example | 2-15 | 2-15 | 0.44 | 532 |
| Comparative Example | 2-16 | 2-16 | 0.34 | 422 |
| Comparative Example | 2-17 | 2-17 | 0.30 | 640 |
| Comparative Example | 2-18 | 2-1 | 0.25 | 430 |
| Invention Example | 2-19 | 2-1 | 0.49 | 269 |
| Invention Example | 2-20 | 2-2 | 0.73 | 242 |
| Invention Example | 2-21 | 2-3 | 0.64 | 136 |

Corrosion tests were performed on the test specimens of Experimental Examples 2-1 to 2-21 in Table 6 under the following condition. Hydrochloric acid, sulfuric acid and ammonium sulphite were used as reagents to prepare an aqueous solution containing 100 ppm of $Cl^-$, 1,000 ppm of $SO_4^{2-}$ and 1,000 ppm of $SO_3^{2-}$, and then pH of the aqueous solution was adjusted to 3.5 using aqueous ammonia. The aqueous solution was put in a sealed glass container to prevent evaporation and condensation thereof, and halves of the test specimens were immersed in the aqueous solution. This state was retained for 500 hours at 80° C.; and thereby, the corrosion tests were performed. After the tests were completed, corrosion products were removed, and the depth of corrosion was measured by a focal depth method using an optical microscope. In the case where a maximum depth of corrosion was in a range of 400 μm or less, corrosion resistance was evaluated to be satisfactory. The results were illustrated in Table 6.

Samples for surface analysis were cut out from the cold-rolled steel sheets of Material Examples 2-1 to 2-17. The samples for surface analysis were subjected to heat treatments under the same conditions as the heat treatments for corrosion test specimens of Experimental Examples 2-1 to 2-21 in Table 6 to obtain samples for surface analysis of Experimental Examples 2-1 to 2-21. An oxide film on the surface was analyzed by X-ray photoelectron spectroscopy (XPS) and the cationic fraction (A' value) of Cr, Si, Nb, Ti and Al in the oxide film was calculated. XPS was performed using mono-AlKα ray as an X-ray source with an X-ray photoelectron spectrometer made by ULVAC-PHI, Inc. under a condition where the beam diameter of X-ray was approximately 100 μm and a photoelectron output angle was 45 degrees. The results were illustrated in Table 6.

In Table 6, "A' value" indicates a cationic fraction in an oxide film which is represented by the following expression. In addition, underlined values are out of the range of the embodiments.

$$(A' \text{ value}) = (Cr+Si+Ti+Nb+Al)/(\text{the total content of cations})$$

Steels of Experimental Examples 2-1 to 2-12 and 2-19 to 2-21 within the range of the embodiments had 0.4 or greater of A' values (40% or more) according to the test results illustrated in Table 6, and the steels had satisfactory corrosion resistance against the simulated condensate water in exhaust gas.

On the other hand, Experimental Examples 2-13 to 2-15 are Comparative Examples where only one element among Ni, Cu and Mo was included. Experimental Example 2-17 is Comparative Example where the content of Cr and A' value were out of the range of the embodiments. Experimental Examples 2-13 to 2-15 and 2-17 had inferior corrosion resistance against the simulated condensate water in exhaust gas.

In Experimental Example 2-16 which is Comparative Example, a cationic fraction (A' value) in an oxide film, which was formed by simulated brazing heat treatment, did not satisfy the range of the embodiments. Experimental Example 2-16 had less than 0.4 of A' value (less than 40%) and was inferior in corrosion resistance.

In addition, in Experimental Example 2-18, heat treatment was performed in a vacuum without the introduction of $N_2$. Experimental Example 18 had less than 0.4 of A' value (less than 40%) and was inferior in corrosion resistance against the simulated condensate water in exhaust gas.

INDUSTRIAL APPLICABILITY

Since a ferritic stainless steel for a biofuel supply system part of the first embodiment has excellent corrosion resistance against biofuels, the steel is suitably used for a fuel supply system part. In particular, the ferritic stainless steel is suitably used for a part which is in the proximity of an engine and thus, is prone to become hot, for example, a fuel injection system part among a fuel supply system part.

Since a ferritic stainless steel for an exhaust heat recovery unit of the second embodiment has excellent corrosion resistance against condensate water in exhaust gas, the ferritic stainless steel is suitably used for a member of the exhaust heat recovery unit (exhaust gas recirculation system). In particular, the ferritic stainless steel is suitably used for a member of heat exchange section of an exhaust heat recovery unit. Additionally, a ferritic stainless steel is suitably used for members of an exhaust gas passage section such as EGR and a muffler which are exposed to condensate water in exhaust gas.

The invention claimed is:

1. A ferritic stainless steel for a biofuel supply system part comprising, by mass %:

C: 0.03% or less;

N: 0.03% or less;

Si: more than 0.1% to 1% or less;

Mn: 0.02% to 1.2%;
Cr: 15% to 23%;
Al: 0.002% to 0.5%; and
either one or both of Nb and Ti,
with the remainder being Fe and unavoidable impurities,
wherein Expression (1) and Expression (2) illustrated below are satisfied, and
wherein an oxide film is formed on a surface thereof and carbonitrides containing either one or both Nb and Ti are produced on the surface by heat treatment in a vacuum atmosphere containing $N_2$ with a vacuum of $10^{-2}$ torr to 1 torr, and the oxide film contains Cr, Si, Nb, Ti and Al in a total cationic fraction of 30% or more and Cr in a cationic fraction of 20% or more, $$8(C+N)+0.03 \leq Nb+Ti \leq 0.6 \quad (1)$$

$$Si+Cr+Al+\{Nb+Ti-8(C+N)\} \leq 15.5 \quad (2)$$

each element symbol represents the content (mass %) of the element in Expression (1) and Expression (2).

2. The ferritic stainless steel for a biofuel supply system part according to claim 1, further comprising, by mass %:
one or more elements selected from a group consisting of Ni: 2% or less, Cu: 1.5% or less, Mo: 3% or less, Sn: 0.5% or less, V: 1% or less, W: 1% or less, B: 0.005% or less, Zr: 0.5% or less, Co: 0.2% or less, Mg: 0.002% or less, Ca: 0.002% or less, and REM: 0.01% or less.

3. A biofuel supply system part made of the ferrtic stainless steel for a biofuel supply system part according to claim 1.

4. A biofuel supply system part made of the ferrtic stainless steel for a biofuel supply system part according to claim 2.

5. A ferritic stainless steel for an exhaust heat recovery unit comprising, by mass %:
C: 0.03% or less;
N: 0.05% or less;
Si: more than 0.1% to 1% or less;
Mn: 0.02% to 1.2%;
Cr: 17% to 23%;
Al: 0.002% to 0.5%;
either one or both of Nb and Ti; and
two or three elements selected from a group consisting of Ni: 0.25% to 1.5%, Cu: 0.25% to 1%, and Mo: 0.5% to 2%,
with the remainder being Fe and unavoidable impurities,
wherein Expression (3) and Expression (4) illustrated below are satisfied, and
wherein an oxide film is formed on a surface thereof and (Nb, Ti) carbonitrides containing either one or both Nb and Ti are produced on the surface by heat treatment in a vacuum atmosphere containing $N_2$ with a vacuum of $10^{-2}$ torr to 1 torr, and the oxide film contains Cr, Si, Nb, Ti and Al in a total cationic fraction of 40% or more and Cr in a cationic fraction of 20% or more, $$8(C+N)+0.03 \leq Nb+Ti \leq 0.6 \quad (3)$$

$$Si+Cr+Al+\{Nb+Ti-8(C+N)\} \geq 17.5 \quad (4)$$

each element symbol represents the content (mass %) of the element in Expression (3) and Expression (4), and in addition, the value of Nb+Ti−8(C+N) is equal to or greater than 0 in Expression (4).

6. The ferritic stainless steel for an exhaust heat recovery unit according to claim 5, further comprising, by mass %:
one or more elements selected from a group consisting of V: 0.5% or less, W: 1% or less, B: 0.005% or less, Zr: 0.5% or less, Sn: 0.5% or less, Co: 0.2% or less, Mg: 0.002% or less, Ca: 0.002% or less, and REM: 0.01% or less.

7. An exhaust heat recovery unit comprising:
a heat exchange section of which members are fabricated by brazing,
wherein the heat exchange section is made of a ferritic stainless steel,
wherein the ferritic stainless steel comprises, by mass %: C: 0.03% or less; N: 0.05% or less; Si: more than 0.1% to 1% or less; Mn: 0.02% to 1.2%; Cr: 17% to 23%; Al: 0.002% to 0.5%; either one or both of Nb and Ti; and two or three elements selected from a group consisting of Ni: 0.25% to 1.5%, Cu: 0.25% to 1% and Mo: 0.5% to 2%, with the remainder being Fe and unavoidable impurities,
wherein Expression (3) and Expression (4) illustrated below are satisfied, and
wherein an oxide film is formed on a surface thereof and (Nb, Ti) carbonitrides containing either one or both Nb and Ti are produced on the surface by heat treatment in a vacuum atmosphere containing $N_2$ with a vacuum of $10^{-2}$ torr to 1 torr, and the oxide film contains Cr, Si, Nb, Ti and Al in a total cationic fraction of 40% or more and Cr in a cationic fraction of 20% or more, $$8(C+N)+0.03 \leq Nb+Ti \leq 0.6 \quad (3)$$

$$Si+Cr+Al+\{Nb+Ti-8(C+N)\} \geq 17.5 \quad (4)$$

each element symbol represents the content (mass %) of the element in Expression (3) and Expression (4), and the value of Nb+Ti−8(C+N) is equal to or greater than 0 in Expression (4).

8. The exhaust heat recovery unit according to claim 7,
wherein the ferritic stainless steel further comprises one or more elements selected from a group consisting of, by mass %, V: 0.5% or less, W: 1% or less, B: 0.005% or less, Zr: 0.5% or less, Sn: 0.5% or less, Co: 0.2% or less, Mg: 0.002% or less, Ca: 0.002% or less, and REM: 0.01% or less.

* * * * *